US006220341B1

(12) United States Patent
Izumi et al.

(10) Patent No.: US 6,220,341 B1
(45) Date of Patent: Apr. 24, 2001

(54) AIR CONDITIONING SYSTEM

(75) Inventors: Masashi Izumi; Nobuhiro Idei; Akira Hatakeyama; Toshio Kubo; Mamoru Kubo, all of Gunma-ken (JP)

(73) Assignee: Sanyo Electric Co., Ltd., Osaka-Fu (JP)

( * ) Notice: Subject to any disclaimer, the term of this patent is extended or adjusted under 35 U.S.C. 154(b) by 0 days.

(21) Appl. No.: 09/195,471

(22) Filed: Nov. 18, 1998

(30) Foreign Application Priority Data

Nov. 19, 1997 (JP) ..... 9-318582
Nov. 19, 1997 (JP) ..... 9-318589
Nov. 19, 1997 (JP) ..... 9-318593
Dec. 5, 1997 (JP) ..... 9-336012

(51) Int. Cl.[7] ..... F28D 15/00; F28F 27/00
(52) U.S. Cl. ..... 165/104.25; 165/274
(58) Field of Search ..... 165/104.25, 274, 165/272, 282

(56) References Cited

U.S. PATENT DOCUMENTS 2,484,542 * 10/1949 Atwood ..... 165/104.25
3,799,243 * 3/1974 Castillo ..... 165/50
4,843,832 * 7/1989 Yamada et al. ..... 62/159
5,103,897 * 4/1992 Cullimore et al. ..... 165/274
5,363,668 * 11/1994 Nakao et al. ..... 62/141
5,607,013 * 3/1997 Inoue et al. ..... 165/104.21

FOREIGN PATENT DOCUMENTS 7-151359 6/1995 (JP) .
7-318189 12/1995 (JP) .

* cited by examiner

*Primary Examiner*—Ira S. Lazarus
*Assistant Examiner*—Tho Duong
(74) *Attorney, Agent, or Firm*—Weingarten, Schurgin, Gagnebin & Hayes LLP

(57) ABSTRACT

An air conditioning system comprises a heat source side machine, a plurality of user side machines more than half of which are disposed below the heat source side machine, and liquid phase and gas phase pipes connecting the heat source side machine with the user side machines to form a closed circuit. A phase-changeable fluid included in the closed circuit circulates by utilizing its own specific gravity difference between the liquid and gas phases, so that each of the user side machines can perform cooling and heating operations. The liquid phase pipe and the gas phase pipe can communicate with each other via a gas bypass circuit and/or a liquid bypass circuit including a open-close valve and liquid level detection means, so that bubbles or condensed liquid generated in the closed circuit can be exhausted quickly.

1 Claim, 12 Drawing Sheets

1
2
3
3A
3B
4
4A
4B
5
6
7
8
9
10
11
12
13
14
15
16
17
18
19
20
21
22
23

AIR CONDITIONING SYSTEM

BACKGROUND OF THE INVENTION

1. Field of the Invention

The present invention relates to an air conditioning system, and more particularly to a system circulating a phase-changeable fluid between gas and liquid phases between a heat source side machine and a plurality of user side machines all or more than half of which are disposed below the heat source side machine, so that each of the user side machines can perform cooling or heating operation.

2. Background Art

An example of the above-mentioned type air conditioning system is shown in FIG. 12. This air conditioning system includes a heat source side machine 1 that performs cooling or heating selectively, and user side machines 2 all or more than half of which are disposed below the heat source side machine 1. The heat source side machine 1 and each of the user side machines 2 are connected with each other via a liquid phase pipe 3 and a gas phase pipe 4 so as to form a closed circuit 5. This closed circuit 5 includes a phase-changeable fluid, i.e., a refrigerant. When this refrigerant is cooled and condensed in the heat source side machine 1, the condensed liquid refrigerant is led to each of the user side machines 2 by opening a cooling/heating switch valve 6 provided in the liquid phase pipe 3. Then, a heat exchanger 7 of each user side machine 2 performs heat exchange between the refrigerant and room air so as to perform cooling operation. During this heat exchange, the refrigerant gains heat to evaporate. The evaporated gas refrigerant flows in the gas phase pipe 4 and backs to the heat source side machine 1 that has been in a low pressure. Thus, cooling operation is performed in each of the user side machines 2.

When the refrigerant is heated and evaporated in the heat source side machine 1, the gas refrigerant evaporated in the heat source side machine 1 is led to each of the user side machines 2 via the gas phase pipe 4. Then, the heat exchanger 7 of each user side machine 2 performs heat exchange between the refrigerant and room air to perform heating operation. The liquid refrigerant condensed after discharging heat in the heat exchange process flows back to the heat source side machine 1 utilizing a discharging force of the electric pump 8 provided in the liquid phase pipe 3. Thus, each of the user side machines 2 performs heating operation.

Reference numeral 9 denotes a flow control valve, reference numeral 10 denotes a receiver tank, reference numeral 11 denotes a cooling/hating switch valve and reference numeral 12 denotes a blower.

In the above mentioned configuration of the air conditioning system, the phase-changeable refrigerant circulates in the closed circuit by its specific gravity difference between liquid and gas phases. Therefore, the configuration has an advantage in that power consumption can be reduced.

There is another configuration of the air conditioning system in which the liquid phase pipe 3 of the heat source side machine 1 is provided with a receiver tank 13 and an electric pump 14 that works in cooling operation as shown in the broken line in the figure. This configuration can enhance circulation ability of the refrigerant, so that some of the user side machines 2 can be placed at a little higher position than the heat source side machine 1. This electric pump 14 can be compact compared with the electric pump 8 that needs to have power for driving the liquid refrigerant condensed in the user side machine 2 to the heat source side machine 1 disposed at an upper place. Therefore, this configuration has an effect of reducing power consumption compared with the air conditioning system piped so that the circulation in the cooling operation can be performed utilizing the electric pump 8.

Another configuration of the system is disclosed in Unexamined Japanese Patent Publication Hei 7-151359 for example, in which the liquid phase pipe is provided with four open-close valves disposed closely to the electric pump 8 so as to use the electric pump 8 also for forcing circulation of the refrigerant in the cooling operation.

However, in each of the above mentioned configuration of the air conditioning system performing cooling operation, pressure of the phase changeable refrigerant in the closed circuit is always altering due to load variation or other factors. Thus, the liquid refrigerant can generate bubbles by evaporating partially when the pressure drops.

Especially when starting the cooling operation, the temperature of the liquid refrigerant is relatively high being heated by outside air even if the liquid phase pipe is covered with a heat insulator. Therefore, the refrigerant in the liquid phase pipe may bubble in concert if the pressure of the closed circuit drops rapidly after start of the cooling operation in the heat source side machine. If a cooling load is small and thus the amount of the circulating refrigerant is little, the refrigerant is easily affected by the outside air. In this partial load operation, the refrigerant may bubble in the liquid phase pipe responding to a slight pressure drop. Furthermore, the bubbles can be generated by the outside air invading into devices provided to the pipe.

The bubbles generated in the liquid phase pipe as mentioned above can make circulation of the liquid refrigerant unstable or distribution of the liquid refrigerant to each user side machine uncertain. As a result, it may happen that a room cannot be cooled sufficiently. Furthermore, since the amount of the refrigerant increases on the surface, it becomes difficult to circulate the refrigerant to each user side machine, and the cooling operation may be difficult to continue.

Furthermore, in the above mentioned air conditioning system, the liquid refrigerant condensed after discharging heat in the heat source side machine enters each of the user side machines and evaporates. Then the refrigerant flows back to the heat source side machine. Thus, a one-way path is formed. Therefore, there is a disadvantage in that it is difficult to remove bubbles if generated, and the bad affection of the bubbles lasts long hours. In this case, the bubbles gathered in an inlet of each user side machine should be removed from an outlet by once fully opening an expansion valve. However, this operation can cause a bad circulation of the refrigerant since not only bubbles but also liquid refrigerant can be removed from the outlet of the user side machine, resulting in detention of the liquid refrigerant in the gas phase pipe (so-called liquid back).

Therefore, it is required to remove the bubbles quickly if the refrigerant flowing in the liquid phase pipe generates bubbles during cooling operation.

On the other hand, during heating operation, the gas refrigerant heated and evaporated in the heat source side machine can be cooled and condensed in the gas phase pipe. Especially, when starting the heating operation, the gas pipe is substantially at a low temperature even if it is covered with an insulator. Therefore, the gas refrigerant heated and evaporated in the heat source side machine is easily condensed in the gas phase pipe. The condensed refrigerant generated in the gas phase pipe may cause unstable circulation of the refrigerant to the user side machine or uncertain distribution of the refrigerant to each of the user side machine, resulting in a problem of insufficient heating of a room. In addition, if the refrigerant is condensed and remains in the pipe, the refrigerant becomes insufficient on the surface and the operation may stop.

Therefore, if the refrigerant flowing in the gas phase pipe is condensed in the heating operation, it is necessary to remove the liquid refrigerant in the pipe quickly.

SUMMARY OF THE INVENTION

A purpose of the present invention is to provide an air conditioning system that can remove bubbles generated in a liquid phase pipe during cooling operation to the liquid phase pipe quickly so that the generated bubbles can not influence the circulation of the liquid refrigerant to each of the user side machines.

Another purpose of the present invention is to provide an air conditioning system that can remove the condensed refrigerant generated in a gas phase pipe during heating operation to a liquid phase pipe quickly so that the condensed refrigerant can not influence the circulation of the gas refrigerant to each of user side machines.

A first aspect of the present invention provides an air conditioning system that comprises a heat source side machine, a plurality of user side machines more than half of which are disposed below the heat source side machine, and pipes for communicating the heat source side machine and the user side machines. The pipes comprise a liquid phase pipe and a gas phase pipe so as to form a closed circuit. A phase-changeable fluid included in the closed circuit circulate between the heat source side machine and the user side machines utilizing its specific gravity difference between liquid and gas phases so that each of the user side machines can perform at least cooling operation. The liquid phase pipe comprises a trunk liquid phase pipe and branch liquid phase pipes extended from the trunk liquid phase pipe to each of the user side machines. An upper portion of the trunk liquid phase pipe and the gas phase pipe can be communicated with each other via a bypass circuit.

A second aspect of the present invention provides an air conditioning system that comprises a heat source side machine, a plurality of user side machines more than half of which are disposed below the heat source side machine, and pipes for communicating the heat source side machine and the user side machines. The pipes comprise a liquid phase pipe provided with a pump and a gas phase pipe so as to form a closed circuit. A phase-changeable fluid included in the closed circuit circulates between the heat source side machine and the user side machines by a driving force of the pump so that each of the user side machines can perform heating operation. The gas phase pipe comprises a trunk gas phase pipe connected to the heat source side machine and branch gas phase pipes extended from the trunk gas phase pipe to each of the user side machines. The lowest portion of the trunk gas phase pipe and the liquid phase pipe can be communicated with each other via a bypass circuit.

In the first and second aspects mentioned above, the bypass circuit preferably comprises detection means for detecting a liquid level of the refrigerant remaining in the bypass circuit, and an open-close valve that is opened or closed in accordance with an output signal of the liquid level detection means.

A third aspect of the present invention provides an air conditioning system that comprises a heat source side machine, a plurality of user side machines more than half of which are disposed below the heat source side machine, and pipes for communicating the heat source side machine and the user side machines. The pipes comprise a liquid phase pipe provided with a pump and a gas phase pipe so as to form a closed circuit. A phase-changeable liquid included in the closed circuit circulates between the heat source side machine and the user side machines in the closed circuit utilizing its specific gravity difference between liquid and gas phases and a discharging force of the pump, so that each of the user side machines can perform cooling operation. The system further comprises a second liquid phase pipe that extends from the lower portion of the liquid phase pipe connecting with the lowest user side machine to the heat source side machine.

In this aspect, it is preferable that the second liquid phase pipe is provided with a second pump for driving the phase-changeable fluid to the heat source side machine, and control means is provided for operating the second pump when bubbles are detected in the liquid phase pipe during cooling operation.

Furthermore, a fourth aspect of the present invention provides a method for operating an air conditioning system that comprises a heat source side machine, a plurality of user side machines more than half of which are disposed below the heat source side machine, and pipes for communicating the heat source side machine with the user side machines. The pipes comprise a liquid phase pipe provided with a pump and a gas phase pipe so as to form a closed circuit. A phase-changeable liquid included in the closed circuit circulates between the heat source side machine and the user side machines in the closed circuit utilizing its specific gravity difference between liquid and gas phases and/or a discharging force of the pump so as to perform cooling and heating operations. A liquid phase pipe side port of each user side machine is provided with a control valve that can control flow of the fluid. When starting cooling operation, the heat source side machine starts to operate, the flow control valve is opened, and/or the pump is operated for a short period.

In this aspect, it is preferable that the opening operation of the flow control valve and/or the short period operation of the pump are performed in accordance with an amount of the refrigerant condensed in the heat source side machine.

Moreover, the opening operation of the flow control valve is preferably performed for the flow control valve of the user side machine that is disposed at the upper floor among the plural user side machines.

Furthermore, a fifth aspect of the present invention provides a method for operating an air conditioning system that comprises a heat source side machine, a plurality of user side machines more than half of which are disposed below the heat source side machine, and pipes for communicating the heat source side machine with the user side machines. The pipes comprise a liquid phase pipe provided with a pump and a gas phase pipe so as to form a closed circuit. A phase-changeable liquid included in the closed circuit circulates between the heat source side machine and the user side machines in the closed circuit utilizing its specific gravity difference between liquid and gas phases and/or a discharging force of the pump so that each of the user side machines can perform cooling and heating operation. A liquid phase pipe side port of each user side machine is provided with a flow control valve that can control flow of the fluid. When starting heating operation, the heat source side machine and the pump start to operate, and at least the flow control valve of the user side machine disposed at a lower floor is opened.

Furthermore, a sixth aspect of the present invention provides a method for operating an air conditioning system that comprises a heat source side machine, a plurality of user side machines more than half of which are disposed below the heat source side machine, and pipes for communicating the heat source side machine with the user side machines. The pipes comprise a liquid phase pipe provided with a pump and a receiver tank connected to an inlet side of the pump, for leading the fluid condensed in the user side machine to the heat source side machine, a second liquid phase pipe provided with a cooling/heating switch valve that opens for cooling operation and closes for heating operation, for connecting the outlet side of the pump with the receiver tank, and a gas phase pipe, so as to form a closed circuit. A phasechangeable liquid included in the closed circuit circulates between the heat source side machine and the user side machines in the closed circuit utilizing its specific gravity difference between liquid and gas phases and/or a discharging force of the pump so that each of the user side machines can perform cooling and heating operation. When starting cooling operation, the heat source side machine and the pump start to operate, the cooling/heating switch valve is opened, and a refrigerant flow control valve is opened in the user side machine that is not instructed to perform cooling operation. Later, the pump is stopped, and the refrigerant flow control valve is closed in the user side machine that is not instructed to perform cooling operation.

Furthermore, a seventh aspect of the present invention provides a method for operating an air conditioning system that comprises a heat source side machine, a plurality of user side machines more than half of which are disposed below the heat source side machine, and pipes for communicating the heat source side machine with the user side machines. The pipes comprise a liquid phase pipe and a gas phase pipe so as to form a closed circuit. A phase-changeable liquid included in the closed circuit can circulate between the heat source side machine and the user side machines utilizing its specific gravity difference between liquid and gas phases. The heat source side machine side of the upper liquid phase pipe is provided with a pump for driving the fluid condensed after discharging heat in the heat source side machine to the user side machine. When starting cooling operation, the heat source side machine and the pump start to operate, a refrigerant flow control valve is opened in the user side machine that is not instructed to perform cooling operation. Later, the refrigerant flow control valve is closed in the user side machine that is not instructed to perform cooling operation.

Furthermore, a eighth aspect of the present invention provides a method for operating an air conditioning system that comprises a heat source side machine, a plurality of user side machines more than half of which are disposed below the heat source side machine, and pipes for communicating the heat source side machine with the user side machines. The pipes comprise a liquid phase pipe and a gas phase pipe so as to form a closed circuit. A phase-changeable liquid included in the closed circuit can circulate between the heat source side machine and user side machines utilizing its specific gravity difference between liquid and gas phases. The heat source side machine side of the upper liquid phase pipe is provided with an auxiliary pump for cooling that drives the fluid condensed after discharging heat in the heat source side machine to the user side machine. The user side machine side of the lower liquid phase pipe is provided with a receiver tank for storing the fluid condensed after discharging heat in the user side machine. A first cooling/heating switch valve is provided to the liquid phase pipe between the outlet of the auxiliary pump for cooling and the user side machine. A second cooling/heating switch valve is provided between the receiver tank and the heat source side machine. A pump for heating is provided for driving back the fluid in the receiver tank to the heat source side machine via the second cooling/heating switch valve. When starting cooling operation, the heat source side machine, the auxiliary pump for cooling and the auxiliary pump for heating start to operate, the first and second cooling/heating switch valves are opened, and a fluid flow control valve is opened in the user side machine that is not instructed to perform cooling operation. Later, the pump for heating is stopped, the second cooling/heating switch valve is closed, and the refrigerant flow control valve is closed in the user side machine that is not instructed to perform cooling operation.

Furthermore, a ninth aspect of the present invention provides a method for operating an air conditioning system that comprises a heat source side machine, a plurality of user side machines more than half of which are disposed below the heat source side machine, and pipes for communicating the heat source side machine and the user side machines. The pipes comprise a liquid phase pipe and a gas phase pipe so as to form a closed circuit. A phase-changeable liquid included in the closed circuit can circulate between the heat source side machine and user side machines utilizing its specific gravity difference between liquid and gas phases. The heat source side machine side of the upper liquid phase pipe is provided with an auxiliary pump for cooling, which drives the fluid condensed after discharging heat in the heat source side machine to the user side machine. The user side machine side of the lower liquid phase pipe is provided with a receiver tank for receiving the fluid condensed after discharging heat in the user side machine. A first cooling/heating switch valve is provided to the liquid phase pipe between the outlet of the auxiliary pump for cooling and the user side machine. A second cooling/heating switch valve is provided between the receiver tank and the heat source side machine. A pump for heating is provided for driving back the fluid in the receiver tank to the heat source side machine via the second cooling/heating switch valve. The discharging side of the pump for heating is connected also with a node between the auxiliary pump for cooling and the first cooling /heating switch valve. When starting cooling operation, the heat source side machine, the auxiliary pump for cooling and the pump for heating start to operate, the first cooling/heating switch valve is opened, the second cooling/heating switch valve is closed, and a refrigerant flow control valve is opened in the user side machine that is not instructed to perform cooling operation. Later, the pump for heating is stopped and the refrigerant flow control valve is closed in the user side machine that is not instructed to perform cooling operation.

Furthermore, a tenth aspect of the present invention provides a method for operating an air conditioning system that comprises a heat source side machine, a plurality of user side machines more than half of which are disposed below the heat source side machine, and pipes for communicating the heat source side machine and the user side machines. The pipes comprise a liquid phase pipe and a gas phase pipe so as to form a closed circuit. A phase-changeable liquid included in the closed circuit can circulate between the heat source side machine and user side machines utilizing its specific gravity difference between liquid and gas phases. The heat source side machine side of the upper liquid phase pipe is provided with an auxiliary pump for cooling that drives the fluid condensed after discharging heat in the heat source side machine to the user side machine. The user side machine side of the lower liquid phase pipe is provided with a receiver tank for receiving the fluid condensed after discharging heat in the user side machine. A first cooling/heating switch valve is provided to the liquid phase pipe between the outlet of the auxiliary pump for cooling and the user side machine. A second cooling/heating switch valve is provided between the receiver tank and the heat source side machine. A pump for heating is provided for driving back the fluid in the receiver tank to the heat source side machine via the second cooling/heating switch valve. The outlet of the pump for heating is connected also between the auxiliary pump for cooling and the first cooling/heating switch valve. When starting cooling operation, the heat source side machine, the auxiliary pump for cooling and the auxiliary pump for heating start to operate, the first and second cooling/heating switch valves are opened, and a fluid flow control valve is opened in the user side machine that is not instructed to perform cooling operation. Later, the pump for heating is stopped, and the second cooling/heating switch valve as well as the refrigerant flow control valve in the user side machine that is not instructed to perform cooling operation is closed.

In the above mentioned method, it is preferable at start of the cooling operation that the pump for heating is not started, but only opening operation of the fluid flow control valve in the user side machine that is not instructed to perform cooling operation is performed, and later the fluid flow control valve in the user side machine that is not instructed to perform cooling operation is closed.

BRIEF DESCRIPTION OF THE DRAWINGS

These and other objects and advantages of the present invention will become clear from the description with reference to the accompanying drawings, wherein.

DETAILED DESCRIPTION OF THE PREFERRED EMBODIMENTS

Figure 1:
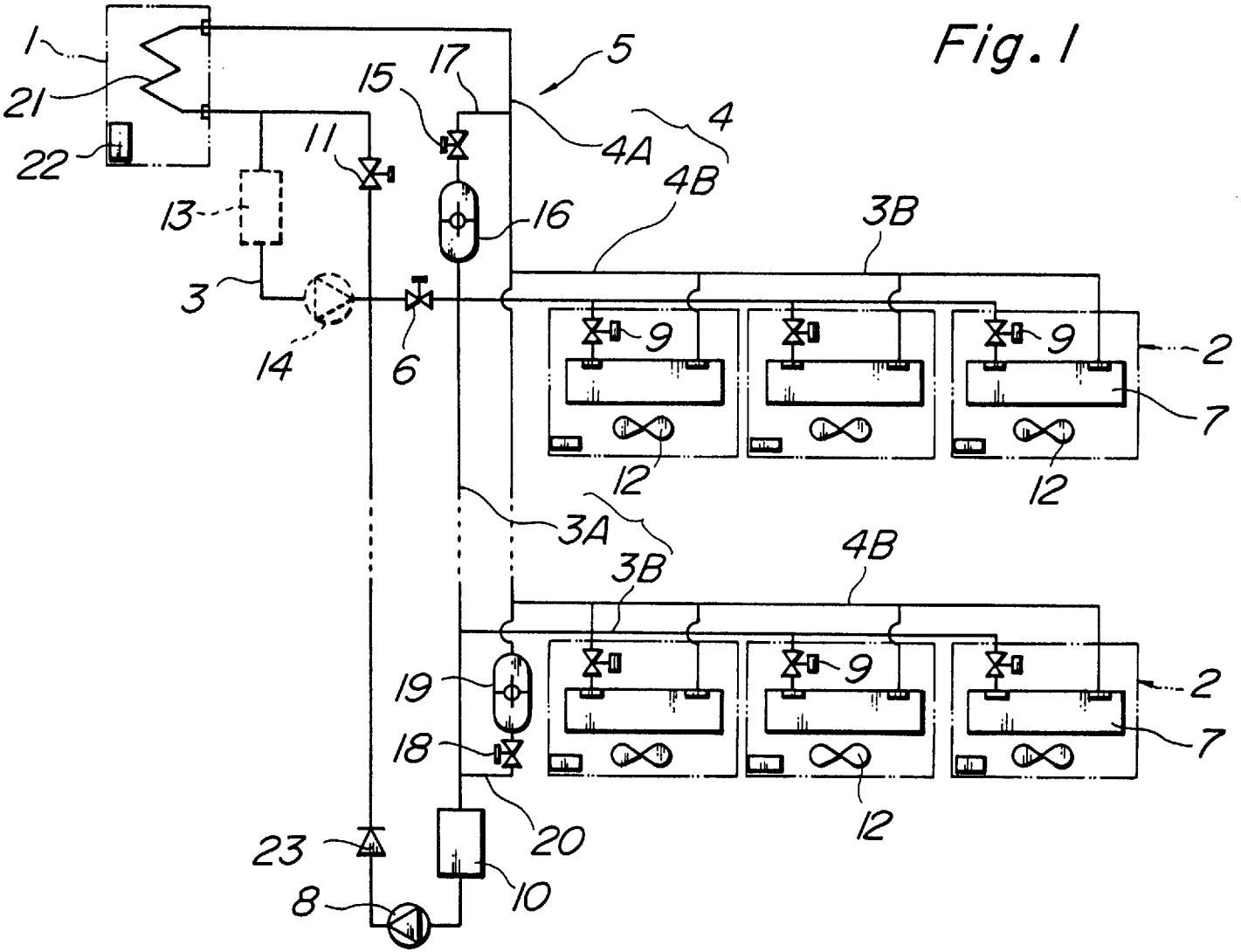
FIG. 1 is an explanatory drawing showing a configuration of an air conditioning system according to the present invention.

The present invention is described in detail hereinafter with reference to embodiments shown in the accompanying drawings. For easy understanding, the same reference numerals are used in these figures as in FIG. 12 for the elements having the same functions explained in FIG. 12.

Figure 12:
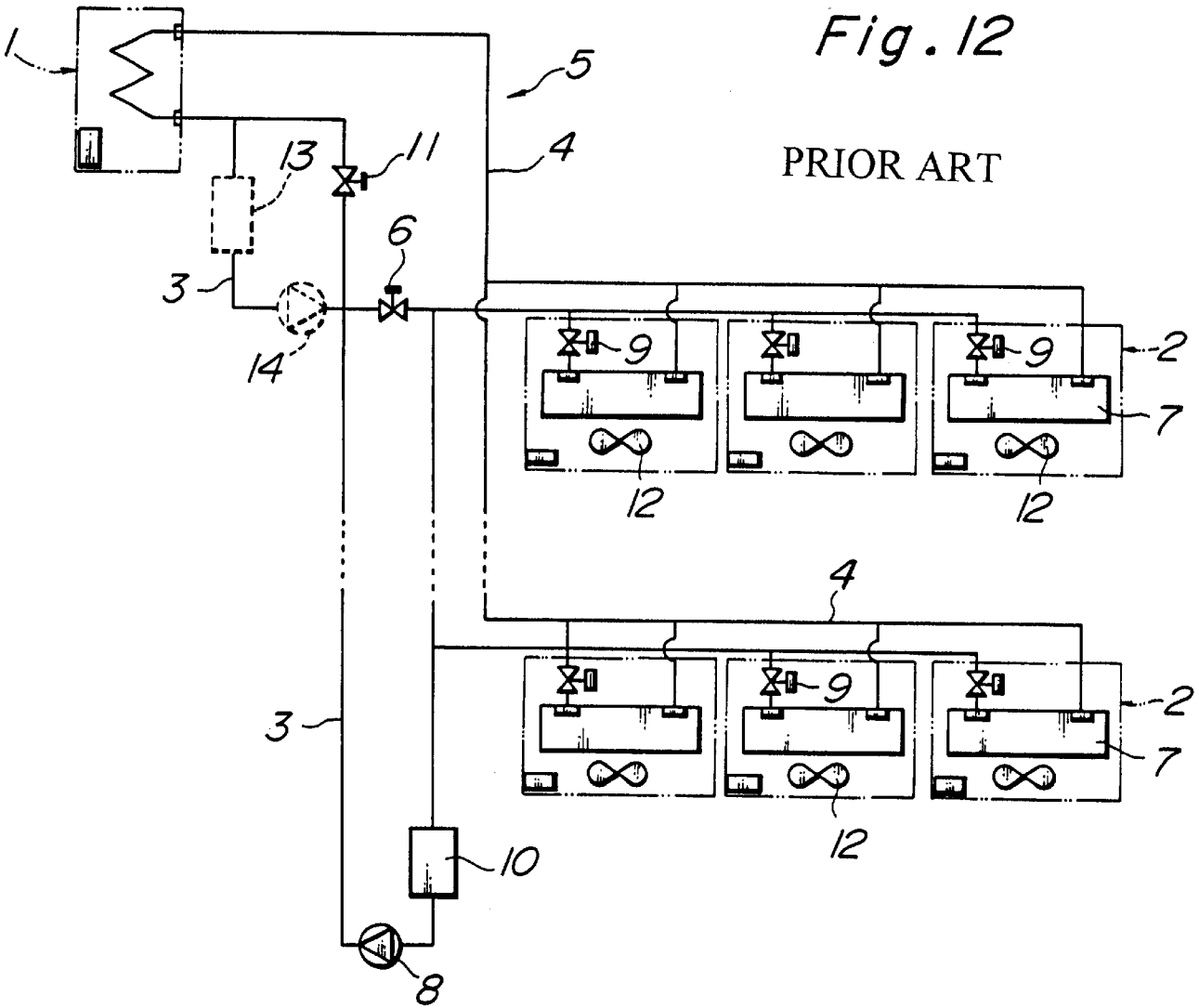
Fig. 12 PRIOR ART
FIG. 12 is an explanatory drawing of the prior art.

FIG. 1 shows an air conditioning system in which the liquid phase pipe 3 and the gas phase pipe 4 of the air conditioning system of the prior art shown in FIG. 12 are connected being able to communicate with each other via a gas bypass circuit 17 and a liquid bypass circuit 20. The gas bypass circuit 17 includes a open-close valve 15 and a liquid level detection means 16, while the liquid bypass circuit 20 includes a open-close valve 18 and a liquid level detection means 19.

The open-close valves 15 and 18 are normally closed and open only when receiving a control signal. Each of the liquid level detection means 16 and 19 has an outlet and an inlet at its upper and lower portions and can detect a liquid level stored in it.

The liquid phase pipe 3 includes a trunk liquid phase pipe 3A connected to the heat source side machine 1, and a plurality of branch liquid phase pipes 3B extending horizontally form the trunk liquid phase pipe 3A to the user side machines 2.

The gas phase pipe 4 includes a trunk gas phase pipe 4A connected to the heat source side machine 1, and a plurality of branch gas phase pipes 4B extending horizontally form the trunk gas phase pipe 4A to the user side machines 2.

The gas bypass circuit 17 connects the upper portion of the trunk liquid phase pipe 3A with the neighboring gas phase pipe 4 in such a way that the liquid phase pipe 3 side is lower than the gas phase pipe 4 side.

The liquid bypass circuit 20 connects the lowest portion of the trunk gas phase pipe 4A with the neighboring liquid phase pipe 3 in such a way that the liquid phase pipe 3 side is lower than the gas phase pipe 4 side.

Furthermore, the heat source side machine 1, which comprises an absorption refrigerator selectable cooling or heating operation via a pipe wall of a heat exchanger 21, is provided with a heat source side controller 22. The heat source side controller 22 controls the open-close valves 15 and 18 to open or close, and controls the cooling/heating switch valves 6 and 11 as well as the electric pump 8 in accordance with an output signal of the liquid level detection means 16 and 19. In addition, a check valve 23 is provided to the liquid phase pipe 3 at the outlet side of the electric pump 8.

An absorption refrigerator disclosed in Unexamined Japanese Patent Publication Hei 7-318189, for example, can be used as one that can perform cooling or heating operation by the heat exchanger 21 that is connected to a evaporator (not shown) of the absorption refrigerator.

In the above-mentioned configuration of the air conditioner according to the present invention, the cooling/heating switch valve 6 is opened, and the cooling/heating switch valve 11 and the open-close valves 15, 18 are opened so as to perform cooling operation in the heat source side machine 1. A phase-changeable refrigerant included in the closed circuit 5 may be a refrigerant R-134*a* that can easily evaporate under a low temperature condition when the pressure drops. This refrigerant is condensed in the heat source side machine 1 after being cooled via the pipe wall of the heat exchanger 21, and is discharged to the liquid phase pipe 3 in a form of liquid refrigerant at a predetermined temperature, e.g., 7 degrees Celsius.

Then, the low temperature liquid R-134*a* flows into each of the user side machines 2 through the flow control valve 9, and take heat via the pipe wall of the heat exchanger 7 from high temperature room air supplied by the blower 12 to perform cooling operation. By this cooling operation, the liquid R-134*a* is evaporated, and the evaporated R-134*a* flow into the gas phase pipe 4 to back to the heat source side machine 1 that is in low pressure after the refrigerant R-134*a* is condensed. Thus, a circulation of the refrigerant R-134*a* is performed.

In the above-mentioned circulation of the refrigerant R-134*a*, a temperature of the liquid R-134*a* flowing into each of the user side machines 2 via the liquid phase pipe 3 rises along with going away from the heat source side machine 1. Therefore, the more bubbles are generated in the lower position of the trunk liquid phase pipe 3A and the position of the branch liquid phase pipe 3B that is farther from the trunk liquid phase pipe 3A. The bubbles generated in the lower portion of the trunk liquid phase pipe 3A go up in the trunk liquid phase pipe 3A and enter the gas bypass circuit 17 disposed above the trunk liquid phase pipe 3A.

A surface of the liquid R-134*a* in the gas bypass circuit 17 is at the upper level corresponding to the open-close valve 15 if there is no bubble, and lowers along with generation of bubbles in the gas bypass circuit 17. Finally, the liquid surface lowers down to a level inside the liquid level detection means 16. When the liquid level detection means 16 detects the liquid level, a predetermined signal is outputted and given to the heat source side controller 22.

The heat source side controller 22, when receiving the signal from the liquid detection means 16, outputs a predetermined control signal to open the open-close valve 15 for a predetermined period for example so that the bubbles invade into the gas bypass circuit 17 and drive out the remaining gas R-134*a* into the gas phase pipe 4. Therefore, even if bubbles are generated in the liquid R-134*a* flowing in the trunk liquid phase pipe 3A of the liquid phase pipe 3, they can be ejected quickly through the gas bypass circuit 17. Thus, the generated bubbles can not influence the circulation of the liquid R-134*a*.

When the liquid R-134*a* flowing in the trunk liquid phase pipe 3A generates bubbles, the liquid R-134*a* flowing in the branch liquid phase pipe 3B also generates bubbles. However, since the branch liquid phase pipe 3B extends horizontally, the bubbles do not remain in the pipe, but rapidly flow into each of the user side machine 2 together with the liquid R-134*a* to be ejected into the gas phase pipe 4. In this case too, the generated bubbles can not influence the circulation of the liquid R-134*a*. Thus, each of the user side machines 2 can always perform normal cooling operation.

On the other hand, when the cooling/warming switch valve 6 and the open-close valves 15 and 18 are closed, when the cooling/warming switch valve 11 is opened, and when the electric pump 8 is started with being heated by the heat source side machine 1, the refrigerant R-134*a* in the closed circuit 5 is heated by the heat source side machine 1 via the pipe wall of the heat exchanger 21, and evaporates. The gas refrigerant is supplied to the heat exchanger 7 of each user side machine 2 via the gas phase pipe 4 at a predetermined temperature, e.g., 55 degrees Celsius. In the heat exchanger 7 of each user side machine 2, the refrigerant R-134*a* discharges heat to room air of a low temperature supplied forcibly by the blower 12, and cooled to be condensed, thereby heating operation is performed. The condensed liquid R-134*a* flows in the receiver tank 10 through the flow control valve 9, and is driven back to the heat source side machine 1 by the driving force of the electric pump 8. Thus, the refrigerant R-134*a* circulates to continue the heating operation.

In the above-mentioned circulation of the refrigerant R-134*a*, a temperature of the gas R-134*a* flowing into each of the user side machines 2 via the gas phase pipe 4 drops along with going away from the heat source side machine 1. Therefore, the more condensed liquid is generated in the lower position of the trunk gas phase pipe 4A and the position of the branch gas phase pipe 4B that is farther from the trunk gas phase pipe 4A. The condensed liquid generated in the lower portion of the trunk gas phase pipe 4A flows down in the trunk gas phase pipe 4A and enters the liquid bypass circuit 20 disposed below the trunk gas phase pipe 4A.

A surface of the refrigerant R-134*a* in the liquid bypass circuit 20 rises from the level corresponding to the open-close valve 18 along with generation of condensed liquid in the liquid bypass circuit 20. Finally, the liquid surface rises up to a level inside the liquid level detection means 19. When the liquid level detection means 19 detects the liquid level, a predetermined signal is outputted and given to the heat source side controller 22.

The heat source side controller 22, when receiving the signal from the liquid detection means 19, outputs a predetermined control signal to open the open-close valve 18 for a predetermined period for example so that the liquid R-134*a*, which had invaded and remained in the liquid bypass circuit 20, is drove out to the liquid phase pipe 3. Therefore, even if the gas R-134*a*flowing in the trunk gas phase pipe 4A of the gas phase pipe 3 is condensed, the condensed liquid can be ejected quickly through the liquid bypass circuit 20. Thus, the condensed liquid in the gas phase pipe 4 can not influence the circulation of the gas R-134*a*.

When the gas R-134*a* flowing in the trunk gas phase pipe 4A is condensed, the gas R-134*a* flowing in the branch gas phase pipe 4B is also condensed. However, since the branch gas phase pipe 4B extends horizontally, the condensed liquid does not remain in the pipe, but flows into each of the user side machine 2 and is ejected to the liquid phase pipe 3 together with the refrigerant R-134*a* that has been condensed after flowing in as a gas. In this case too, the condensed liquid in the gas phase pipe 4 can not influence the circulation of the gas R-134*a*. Thus, each of the user side machines 2 can always perform normal heating operation.

In this air conditioning system of the present invention too, a receiver tank 13 and an electric pump 14 can be provided as illustrated in the broken line.

In this configuration, since the driving force of the electric pump 14 adding to the specific gravity difference between liquid and gas phases of the refrigerant R-134*a* can be used during cooling operation, a difficulty for the refrigerant R-134*a* to flow in due to the height of the floor where the user side machine 2 is installed can be improved. Thus, some of the user side machines 2 can be installed at the same floor as the heat source side machine 1, or at the higher floor than the heat source side machine 1. The electric pump 14 can be compact compared with the electric pump 8 that is disposed at the lower portion of the liquid phase pipe 3 since it is used for driving the liquid R-134*a* condensed after discharging heat in the heat source side machine 1 to the user side machines 2 majority of which are installed below the heat source side machine 1.

Figure 2:
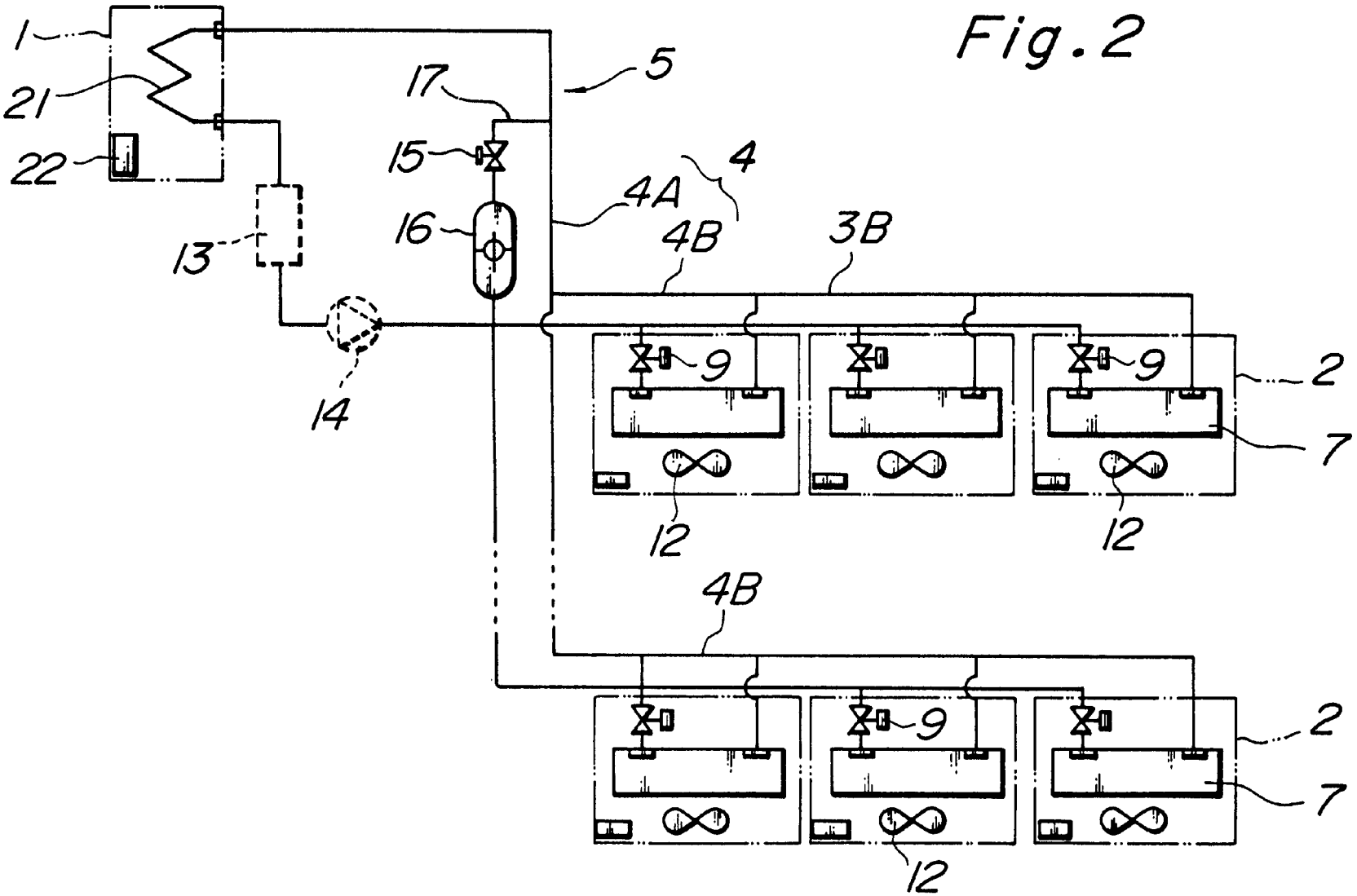
FIG. 2 is an explanatory drawing showing a configuration of an air conditioning system according to the present invention.

The air conditioning system can be a dedicated one for cooling operation as shown in FIG. 2, in which the receiver tank 10, the electric pump 8, and the cooling/heating switch valves 6 and 11 are removed.

Figure 3:
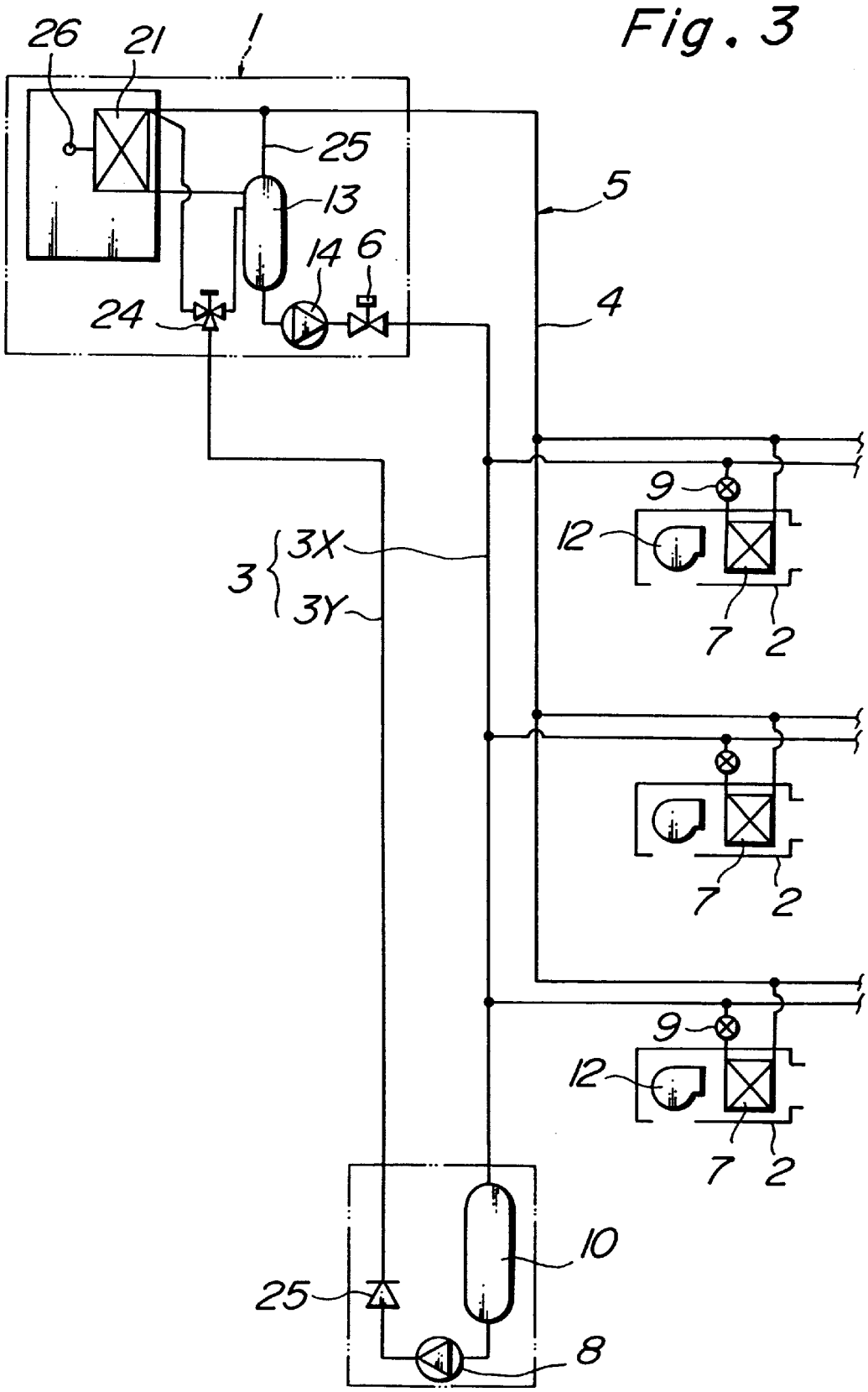
FIG. 3 is an explanatory drawing showing a configuration of an air conditioning system according to the present invention.

In the air conditioning system shown in FIG. 3 has a liquid phase pipe 3 including a first liquid phase pipe 3X and a second liquid phase pipe 3Y. The liquid phase pipe 3X is provided with the receiver tank 13, the electric pump 14 and the cooling/heating switch valve 6 connected in series, and is connected to each of the user side machines 2 via each flow control valve 9. The second liquid phase pipe 3Y branches and extends from the lower portion of the first liquid phase pipe 3X, and is provided with the receiver tank 10, the electric pump 8 and the check valve 23 disposed in series at the lowest portion of the pipe. In addition, there is a three-way valve 24 that is controlled in such a way that the liquid R-134*a* is supplied to the heat exchanger 21 via the check valve 23 during cooling operation, while it is supplied to the receiver tank 13 during heating operation.

In this case too, the electric pump 14 of the first liquid phase pipe 3X can be a compact one since it is used for driving the liquid R-134*a* condensed after discharging heat in the heat source side machine 1 to the user side machines 2 majority of which are installed below the heat source side machine 1. On the contrary, the electric pump 8 of the second liquid phase pipe 3Y should be a large one since it is used for driving the liquid R-134*a* condensed after discharging heat in the user side machine 2 to the heat source side machines 1 that is installed at the upper position.

The receiver tank 13, the electric pump 14, the cooling/heating switch valve 6 and the three-way valve 24 are incorporated inside the heat source side machine 1. A gas phase portion of the receiver tank 13 and the gas phase pipe 4 are communicated with each other via a thin pressure-equalizing pipe 25. In addition, a liquid level sensor 26 are provided for detecting a level of the liquid R-134*a* in the heat exchanger 21.

Furthermore, the heat source side machine 1 has a function of controlling an input heat so that the temperature of the refrigerant R-134*a* being discharged into the liquid phase pipe 3 after being cooled in the heat exchanger 21 during cooling operation becomes a predetermined temperature, e.g., 7 degrees Celsius. The user side machine 2 has a function of controlling a opening ratio of the flow control valve 9 so that the raised temperature of the refrigerant R-134*a* being discharged into the gas phase pipe 4 after performing cooling operation in the heat exchanger 7 becomes a predetermined temperature, e.g., 12 degrees Celsius.

A circulation cycle of the refrigerant R-134*a* included in the closed circuit 5 during cooling operation will be explained below. The refrigerant R-134*a* is condensed after being cooled via the pipe wall of the heat exchanger 21 in the heat source side machine 1. The condensed refrigerant R-134*a* flows into the first liquid phase pipe 3X, and is stocked in the receiver tank 13. Later, by the discharging power of the electric pump 14, a part of the refrigerant R-134*a* is supplied to the heat exchanger 7 of each user side machine 2 to perform cooling operation, while the other part of the refrigerant R-134*a* is driven back to the heat exchanger 21 via the second liquid phase pipe 3Y that branches from the lower portion of the first liquid phase pipe 3X.

In other words, a part of the refrigerant R-134*a* condensed in the heat source side machine performs cooling operation in each of the user side machines 2, while the other part of the refrigerant R-134*a* is always driven back to the heat exchanger 21 via the second liquid phase pipe 3Y. Therefore, even if the amount of the liquid R-134*a* circulated to each of the user side machines 2 is insufficient during partial load operation for example, the amount of the refrigerant R-134*a* flowing in the first liquid phase pipe 3X connected to the second liquid phase pipe 3Y is sufficient. Thus, The influence of the outside air temperature becomes relatively small, so the liquid R-134*a* in the pipe generates little bubbles. In addition, even if bubbles are generated, the refrigerant R-134*a* is driven back to the heat exchanger 21 of the heat source side machine 1 via the second liquid pipe 3Y and is condensed again, so the bubbles do not influence the cooling operation.

When starting cooling operation for example, if a pressure inside the closed circuit 5 is rapidly drops after the heat source side machine 1 starts the cooling operation, the liquid R-134*a* in the liquid phase pipe 3 may generate bubbles all at once. In this case, the electric pump 8 is operated to enhance a power circulating the bubbled R-134*a* back to the heat exchanger 21 of the heat source side machine 1 via the second liquid phase pipe 3Y. Thus, the bubbled R-134*a* flows into the heat exchanger 21 quickly and is condensed after discharging heat, so that the bubbles disappear quickly from the refrigerant R-134*a* within the liquid phase pipe 3.

Figure 4:
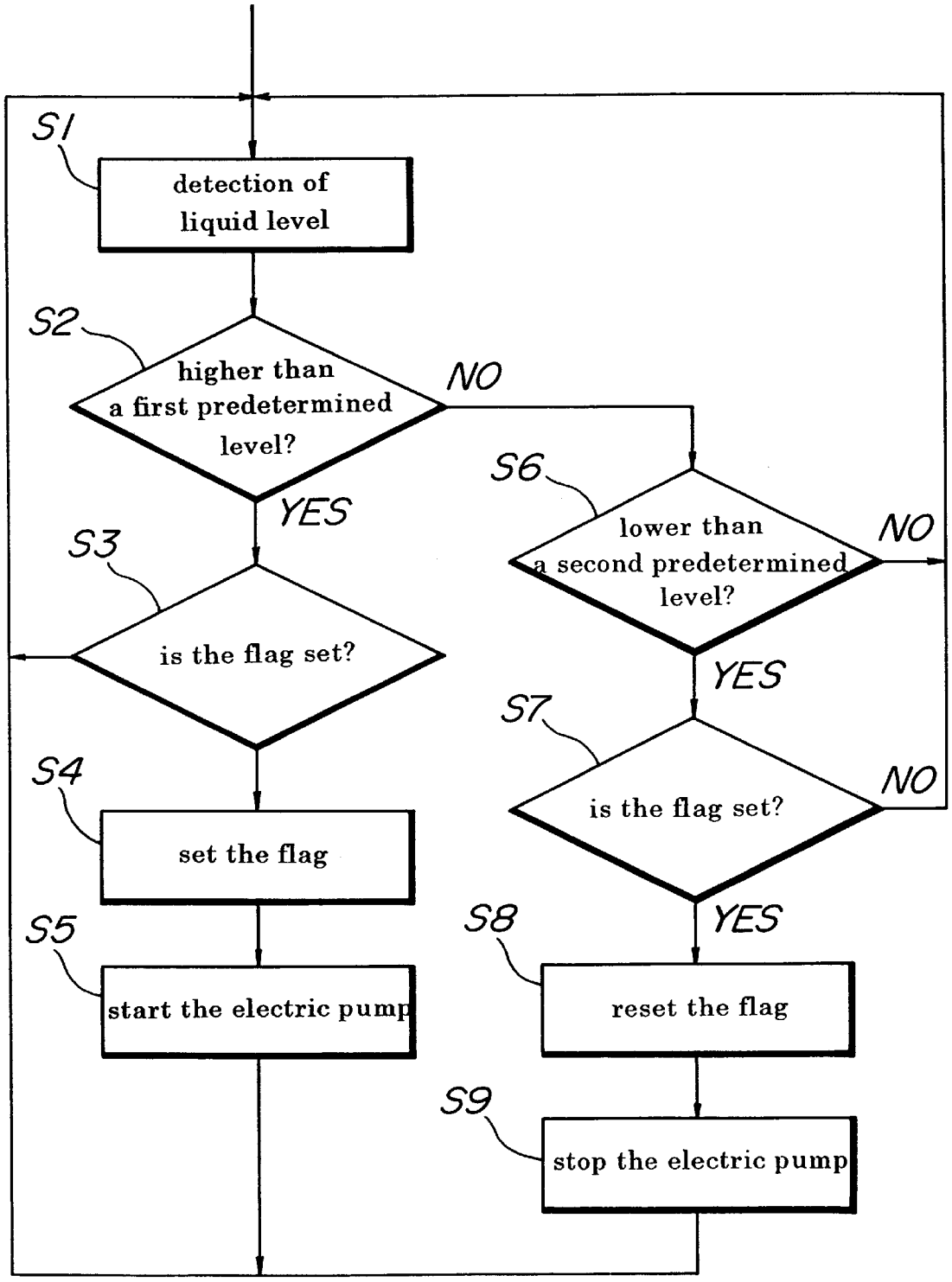
FIG. 4 is an explanatory drawing showing control of an electric pump provided to the second liquid phase pipe according to the present invention.

The electric pump 8 is controlled as follows, as shown in FIG. 4 for example. When the liquid R-134*a* generates bubbles all at once in the liquid phase pipe 3, the volume corresponding to the bubbles is pushed out to the heat source side machine 1, so that the liquid level rises in the heat exchanger 21. When the bubbles disappear, the volume corresponding to the rise of the liquid level flows back to the liquid phase pipe 3, so that the liquid level drops. Therefore, the electric pump 8 is activated when the liquid sensor 26 detects a liquid level higher than a first predetermined level, while it is inactivated when the liquid sensor 26 detects a liquid level lower than a second predetermine level that is lower than the first predetermined level.

In other words, the liquid level sensor 26 detects a level of the liquid R-134*a* at first (Step S1). Then, the detected liquid level is compared with the first predetermined level (Step S2). If the liquid level is higher than the first predetermined level, a flag is checked (Step S3). If the flag is not set, the flag is turned set (Step S4), and the electric pump 8 is activated (Step S5). Then the process returns to Step S1. In addition, if the flag is set in Step S3, the process returns to Step S1.

On the other hand, if the liquid level is not higher than the first predetermined level in Step S2, the process jumps to Step S6. In Step S6, the liquid level is compared with the second predetermined level. If the liquid level is lower than the second predetermined level, the flag is checked (Step S7). If the flag is set, the flag is turned reset (Step S8), and the electric pump 8 is inactivated (Step S9). Then the process returns to Step S1. In addition, if the liquid level is not lower than the second predetermined level in Step 6, and if the flag is not set in Step S7, the process returns to Step S1.

The refrigerant R-134*a* flows into the user side machine 2 from the flow control valve 9 that is opened, takes heat from room air with a high temperature supplied forcibly by the blower 12 via the pipe wall of the heat exchanger 7 so as to perform cooling operation. Then the evaporated gas R-134*a* flows into the gas phase pipe 4 and back to the heat exchanger 21 of the heat source side machine 1 that is in a low pressure after the refrigerant R-134*a* has been cooled and condensed. Then, the refrigerant R-134*a* is condensed again after discharging heat. Thus, the refrigerant R-134*a*circulates in the manner as known well in the art.

On the other hand, stopping the operation of the electric pump 14, opening the cooling/heating switch valve 6, performing heating operation in the heat source side machine, and operating the electric pump 8 in the second liquid phase pipe 3Y makes the user side machine 2 perform heating operation.

In other wards, the refrigerant R-134*a* in the closed circuit 5 is heated via the pipe wall of the heat exchanger 21 and is evaporated. The evaporated R-134*a* is supplied to the heat exchanger 7 of each user side machine 2 at a predetermined temperature, e.g., 55 degrees Celsius. In the heat exchanger 7 of each user side machine 2, the refrigerant R-134*a* discharges heat to room air with a low temperature supplied forcibly by the blower 12, and is condensed so as to perform heating operation. Then, the liquid R-134*a*condensed in the heat exchanger 7 flows in the receiver tank 10 via the flow control valve 9. The refrigerant R-134*a* is supplied to the receiver tank 13 by the electric pump 8 and is backed to the heat exchanger 21 of the heat source side machine 1.

Figure 5:
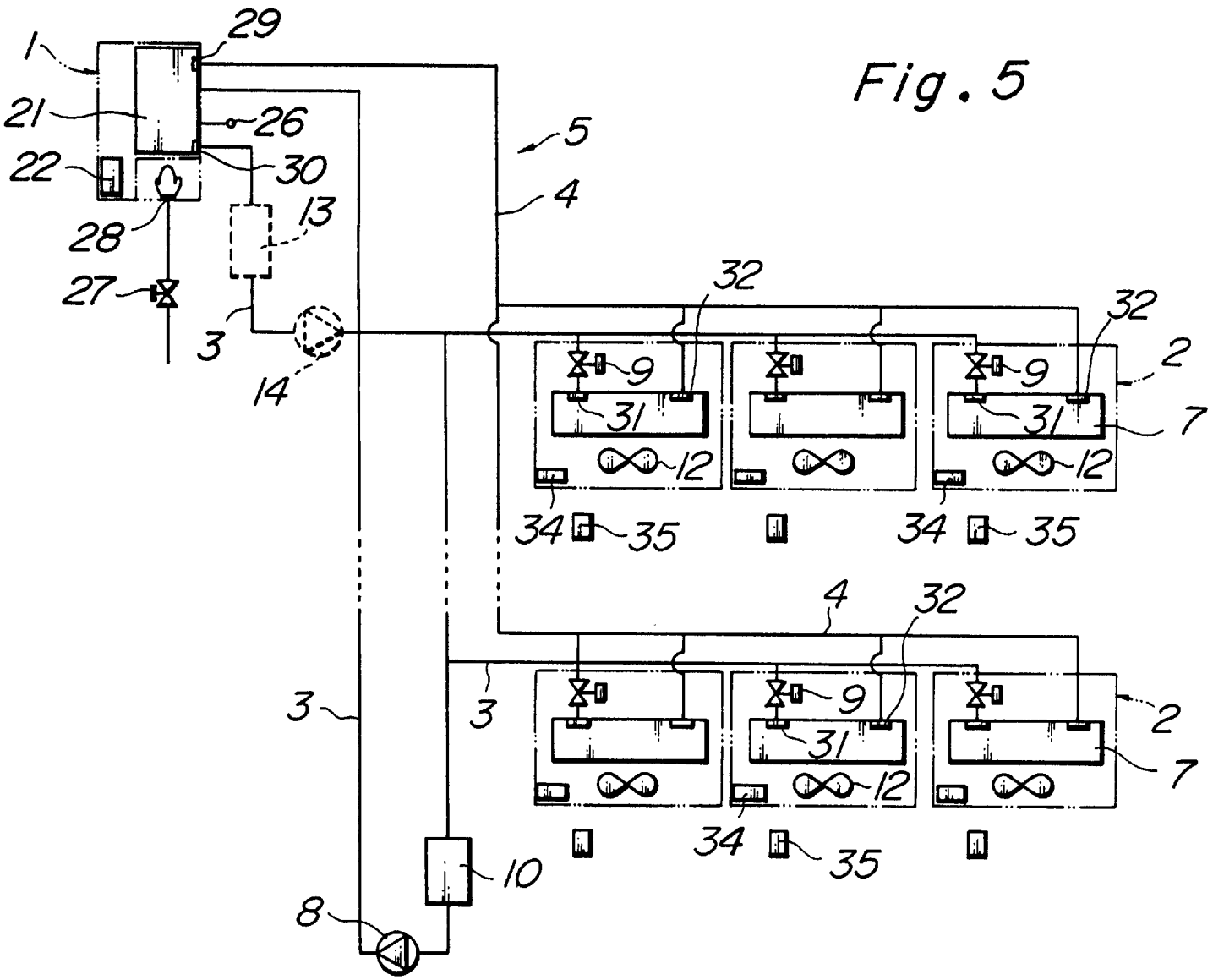
FIG. 5 is an explanatory drawing showing a configuration of an air conditioning system operated by the control method according to the present invention.

In the air conditioning system shown in FIG. 5, the liquid pipe 3 is arranged in the manner that the following operations can be performed. For the heating operation, the refrigerant R-134*a* is condensed in the user side machine 2 to perform heating operation, and the liquid R-134*a* stored in the receiver tank 10 is backed to a middle portion of the heat exchanger 21 of the heart source side machine 1. For the cooling operation, the liquid R-134*a* is supplied to each of the user side machine 2 from a lower portion of the heat exchanger 21.

Reference numeral 27 denotes a fuel adjustment valve provided to a fuel pipe connected to a burner 28 that is used for heating an absorbing solution of the absorption refrigerator (not shown) to separate vapor of the refrigerant. Reference numerals 29-32 denote temperature sensors for detecting temperatures of the refrigerant R-134*a* circulating in the closed circuit 5. The temperature sensors 29 and 30 are disposed at inlet and outlet portions of the heat exchanger 21, respectively. The temperature sensors 31 and 32 are disposed at inlet and outlet portions of the heat exchanger 7, respectively.

The heat source side machine 1 and the user side machines 2 have a heat source side controller 22 and a user side controller 34, which can communicate with each other.

The heat source side controller 22 controls the operation of the electric pump 8. In addition, the heat source side controller 22 has a function to control the opening ratio of the fuel adjustment valve 27 so that the temperature of the refrigerant R-134*a* during cooling operation detected by the temperature sensor 30, that is the temperature of the refrigerant R-134*a*cooled and condensed in the heat exchanger 21 to be discharged into the liquid phase pipe 3, becomes a predetermined temperature, e.g., 7 degrees Celsius. Furthermore, the heat source side controller 22 has a function to control the opening ratio of the fuel adjustment valve 27 so that the temperature of the refrigerant R-134*a* during heating operation detected by the temperature sensor 29, that is the temperature of the refrigerant R-134*a* heated and evaporated in the heat exchanger 21 to be discharged into the gas phase pipe 4, becomes a predetermined temperature, e.g., 55 degrees Celsius.

The user side controller 34 has a function to control the opening ratio of the flow control valve 9 so that the temperature of the refrigerant R-134*a*during cooling operation detected by the temperature sensor 32, that is the temperature of the refrigerant R-134*a* heated and evaporated after performing cooling operation in the heat exchanger 7 to be discharged into the gas phase pipe 4, becomes a predetermined temperature, e.g., 12 degrees Celsius. Furthermore, the user side controller 34 has a function to control the opening ratio of the flow control valve 9 so that the temperature of the refrigerant R-134*a* during heating operation detected by the temperature sensor 31, that is the temperature of the refrigerant R-134*a* cooled and condensed after performing heating operation in the heat exchanger 7 to be discharged into the liquid phase pipe 3, becomes a predetermined temperature, e.g., 50 degrees Celsius.

In addition, each of the user side machines 2 is provided with a remote controller 35, which can communicate with a user side controller 34 for selecting cooling or heating operation, instructing start or stop of the operation, selecting blowing power and setting temperature and other functions.

In the heat source side machine 1 during cooling operation, when the opening ratio of the fuel adjustment valve 27 is increased and fuel supplied to the burner 28 is increased for enhancing the firepower, the amount of the vapor refrigerant separating from the absorbing solution (not illustrated) increases. The increased vapor refrigerant is condensed after discharging heat in a condenser (not illustrated). The liquid refrigerant is supplied to periphery of the heat exchanger 21, and evaporates after taking heat from the refrigerant R-134*a* flowing in the heat exchanger 21. Thus, the function of cooling the refrigerant R-134*a* flowing in the heat exchanger 21 is enhanced, so that a temperature drop becomes large under the same flow condition.

On the contrary, if the opening ratio of the fuel adjustment valve 27 is decreased to lower the firepower, the function of cooling the refrigerant R-134*a* flowing in the heat exchanger 21 is weakened and a temperature drop becomes small.

On the other hand, during heating operation, when the opening ratio of the fuel adjustment valve 27 is increased and fuel supplied to the burner 28 is increased for enhancing the firepower, the amount of the vapor refrigerant separating from the absorbing solution (not illustrated) increases. The increased vapor refrigerant and the absorbing solution after separating vapor refrigerant by being heated are supplied to periphery of the heat exchanger 21, and discharge heat to the refrigerant R-134*a* flowing in the heat exchanger 21. Thus, the function of heating the refrigerant R-134*a* flowing in the heat exchanger 21 is enhanced, so that a temperature rise becomes large under the same flow condition.

On the contrary, if the opening ratio of the fuel adjustment valve 27 is decreased to lower the firepower, the function of heating the refrigerant R-134*a* flowing in the heat exchanger 21 is weakened and a temperature rise becomes small.

In the user side machine 2, on the other hand, if the opening ratio of the flow control valve 9 is constant, a difference between temperatures of the refrigerant R-134*a* detected by the temperature sensors 31 and 32 becomes larger when a load for air conditioning is larger, while it becomes smaller when the load for air conditioning is smaller.

Next, the circulation cycle of the refrigerant R-134*a* included in the closed circuit 5 will be explained below. During cooling operation, the heat source side machine performs cooling operation as mentioned above. Thus, the refrigerant R-134*a* is cooled via a pipe wall of the heat exchanger 21, and is condensed to be discharged into the liquid phase pipe 3. The refrigerant R-134*a* is supplied to the user side machine 2 via the flow control valve 9 at a predetermined temperature, e.g., 7 degrees Celsius.

In each of the user side machines 2, since room air with a high temperature is supplied forcibly to the heat exchanger 7 by the blower 12, the liquid R-134*a* supplied from the heat source side machine 1 at 7 degrees Celsius takes heat from the room air and evaporates so as to perform cooling operation.

The gas R-134*a* flows in the gas pipe 4 and enters the heat exchanger 21 of the heat source side machine 1 that is in low pressure after the refrigerant R-134*a* is cooled and condensed. Thus, the refrigerant circulates naturally.

If a cooling load in a certain user side machine 2 increases (or decreases), the temperature of the refrigerant R-134*a* detected by the temperature sensor 32 of the user side machine 2 rises (or drops). In order to compensate the temperature rise (or drop), the user side controller 34 gives a control signal to the corresponding flow control valve 9 to increase (or decrease) the opening ratio of the valve 9. Then, the amount of the refrigerant R-134*a* increases (or decreases) flowing into the heat exchanger 7 of the user side machine 2 in which the cooling load has increased (or decreased). Thus, the temperature rise (or drop) of the refrigerant R-134*a* detected by the temperature sensor 32 is canceled before long.

If the refrigerant R-134*a* whose temperature is changed due to load variation flows into the heat source side machine 1, or if the flow of the refrigerant R-134*a* flowing into the heat source side machine 1 changes, the temperature of the refrigerant R-134*a* detected by the temperature sensor 30 may change. Then, the opening ratio of the fuel adjustment valve 27 is controlled by the heat source side controller 22 so that the temperature change is canceled.

However, as mentioned above, at start of the cooling operation when the temperature of the liquid phase pipe 3 is high, for example, the liquid R-134*a* can evaporate and bubble all at once in the liquid phase pipe 3. This can be an obstacle to the circulation and supply of the liquid R-134*a* to each of the user side machines 2. Therefore, by the heat source side controller 22 and the user side controller 34, when starting the heat source side machine 1, the blower 12 is stopped, the flow control valve 9 is opened fully, and the electric pump 8 is activated in all of the user side machine 2 that are not instructed to perform cooling operation by the remote controller 35, for example.

Accordingly, even if the liquid R-134*a* generates bubbles in the liquid phase pipe 3 in which pressure has been dropped at start of the cooling operation, the generated bubbles are sent to the heat exchanger 7 of the user side machine 2 with the liquid R-134*a* via the flow control valve 9 that is opened fully, and are exhausted to the gas phase pipe 4. Alternatively, the bubbles are sent to the heat exchanger 21 of the heat source side machine 1 by the electric pump 8 via the liquid phase pipe for heating, and are condensed again. Thus, the bubbles of the R-134*a* in the liquid phase pipe 3 disappears quickly, thereby the starting time of cooling operation can be shortened.

The bubbles of the refrigerant R-134*a* generated in the liquid phase pipe 3 go up in the pipe. Therefore, even if the flow control valve 9 is opened only in the user side machine 2 that is disposed at the highest floor for example among the user side machines 2 that are not instructed to perform cooling operation by the remote controller 35, the bubbles of the refrigerant R-134*a* generated in the liquid phase pipe 3 are quickly exhausted to the gas phase pipe 4. In addition, it is possible to operate either the electric pump 8 or opening of the flow control valve 9.

When the liquid R-134*a* generates bubbles in the liquid phase pipe 3, the volume of the liquid R-134*a* increases on the surface, and the liquid level rises in the heat exchanger 21. Therefore, the liquid level of the refrigerant R-134*a* detected by the liquid level sensor 26 becomes equal to or higher than a predetermined level. In this case, it is possible to activate the electric pump 8 or to open the flow control valve 9 to remove the bubbles from the liquid phase pipe 3 only when detected generation of too many bubbles in the liquid phase pipe 3 to circulate and to supply the liquid R-134*a* to each of the user side machines 2.

In this case, it is possible to control the electric pump 8 and the flow control valve 9 as follows. When the liquid level of the refrigerant R-134*a* detected by the liquid level sensor 26 in the heat exchanger 21 becomes equal to or higher than the first predetermined level, the electric pump 8 is activated, or the flow control valve 9 is opened fully. When the liquid level of the refrigerant R-134*a* detected by the liquid level sensor 26 becomes equal to or higher than the second predetermined level higher than the first liquid level, the electric pump 8 is activated, and the flow control valve 9 is opened fully.

Figure 6:
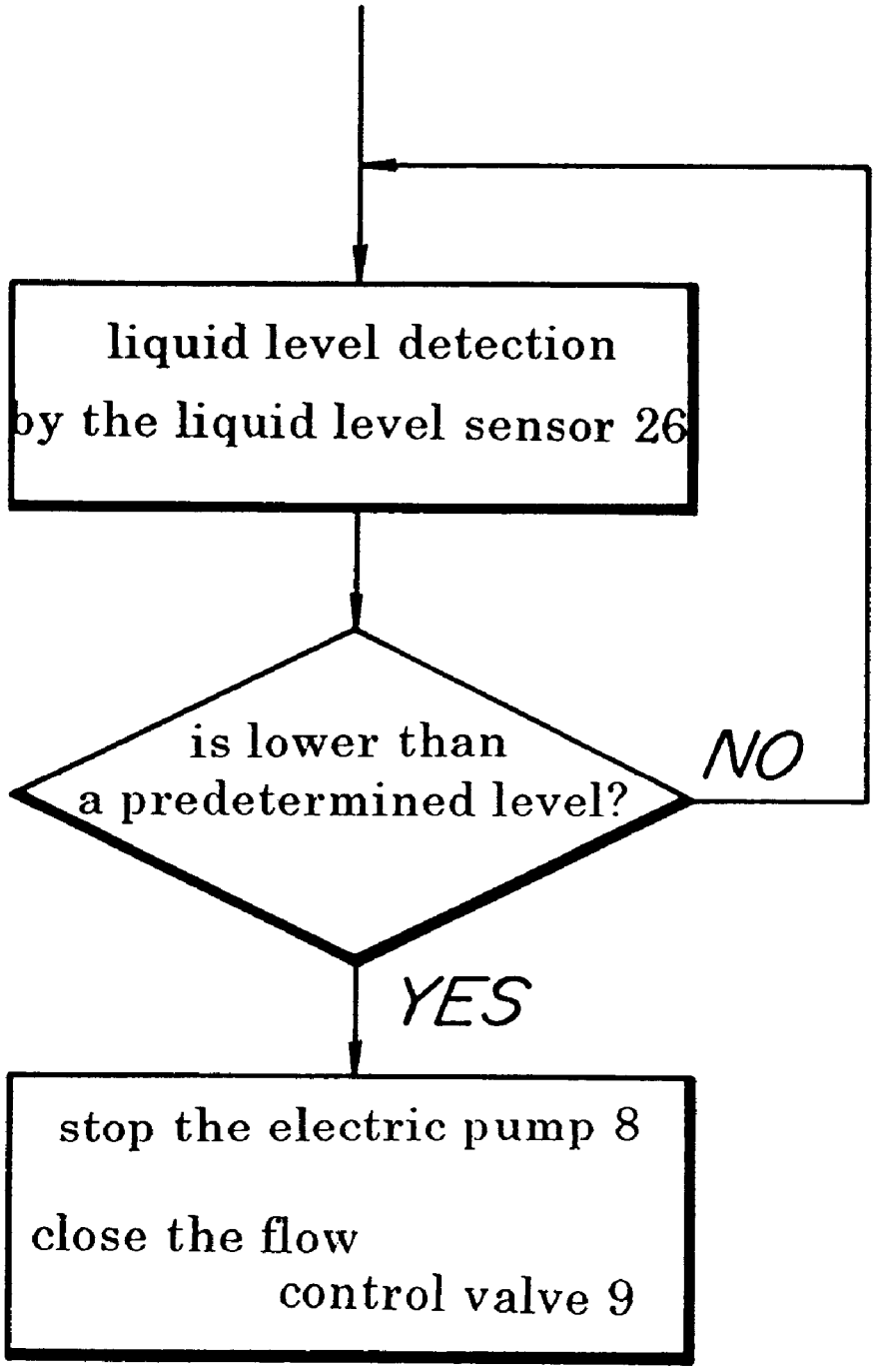
FIG. 6 is an explanatory drawing showing control at start of cooling operation of the air conditioning system shown in FIG. 5

The stop operation of the electric pump 8 and the close operation of the flow control valve 9 that is opened fully are performed as shown in FIG. 6, for example. The operations are performed after confirming that the bubbles have disappeared from the liquid R-134*a* in the liquid phase pipe 3 by the liquid level sensor 26 as lowering of the liquid level in the heat exchanger 21.

The detection of the liquid level of the refrigerant R-134*a* in the heat exchanger 21 by the liquid level sensor 26 is performed after passing of sufficient time for the refrigerant R-134*a* to be condensed by cooling operation of the heat source side machine 1 to lower the pressure in the closed circuit 5, and for the liquid R-134*a* in the liquid phase pipe 3 to generate bubbles. Since the refrigerant R-134 does not generate bubbles in the liquid phase pipe 3 immediately after starting the heat source side machine 1 that cannot perform cooling operation sufficiently, the volume of the liquid R-134*a* does not change in the liquid phase pipe 3. Therefore, the level of the liquid R-134*a* detected by the liquid level sensor 26 does not change, too. This is the reason why the detection should be performed after passing of sufficient time.

The air conditioning system can be one that includes a receiver tank 13 and a small electric pump 14 as an auxiliary pump for cooling provided to the liquid phase pipe 3 as illustrated in the broken line in FIG. 5. In the air conditioning system having this configuration, adding to the specific gravity difference of the refrigerant R-134*a* between liquid and gas phases, a drive force of the electric pump 14 can be used in cooling operation. Therefore, some of the user side machines 2 can be placed at a position equal to or higher than the heat source side machine 1.

The cooling operation of the air conditioning system having the electric pump 14 can be started by starting only the heat source side machine and the electric pump 8. Alternatively, the electric pumps 8 and 14 can be started simultaneously for starting cooling operation.

By this starting operation too, the starting time of the cooling operation can be shortened since the bubbles generated in the refrigerant R-134*a* within the liquid phase pipe 3 disappear quickly.

Next, the circulation cycle of the refrigerant R-134*a* in the heating operation is explained below. The heat source side machine 1 performs heating operation as mentioned above. The refrigerant R-134*a* is heated via the pipe wall of the heat exchanger 21 and is evaporated. Then the evaporated refrigerant R-134*a* is discharged into the gas phase pipe 4 and is supplied to the heat exchanger 7 of each user side machine 2 at a predetermined temperature, e.g., 55 degrees Celsius.

In each of the user side machine 2, since room air with a low temperature is supplied forcibly to the heat exchanger 7 by the blower 12, the liquid R-134*a* supplied from the heat source side machine 1 at 55 degrees Celsius discharges heat to the room air and is condensed so as to perform heating operation.

The condensed liquid R-134*a* remains in the receiver tank 10 and is drove to the heat exchanger 21 of the heat source side machine 1 via the liquid phase pipe 3 by the electric pump 8.

In the circulation of the refrigerant R-134*a*, if a heating load in a certain user side machine 2 increases (or decreases), the temperature of the refrigerant R-134*a* detected by the temperature sensor 31 of the user side machine 2 drops (or rises). In order to compensate the temperature drop (or rise), the user side controller 34 gives a control signal to the corresponding flow control valve 9 to increase (or decrease) the opening ratio of the valve 9. Then, the amount of the refrigerant R-134*a* increases (or decreases) flowing into the heat exchanger 7 of the user side machine 2 in which the heating load has increased (or decreased). Thus, the temperature drop (or rise) of the refrigerant R-134*a* detected by the temperature sensor 31 is canceled before long.

If the refrigerant R-134*a* whose temperature is changed due to load variation flows into the heat source side machine 1, or if the flow of the refrigerant R-134*a* flowing into the heat source side machine 1 changes, the temperature of the refrigerant R-134*a* detected by the temperature sensor 30 may change. Then, the opening ratio of the fuel adjustment valve 27 is controlled by the heat source side controller 22 so that the temperature change is canceled.

However, as mentioned above, at start of the cooling operation when the temperature of the gas phase pipe 4 is low, for example, the gas R-134*a* flowing in the gas phase pipe 4 can be condensed to be an obstacle to the circulation and supply of the gas R-134*a* to each of the user side machines 2. Therefore, by the heat source side controller 22 and the user side controller 34, when starting the heat source side machine 1, the blower 12 is stopped in all of the user side machine 2 that are not instructed to perform cooling operation by the remote controller 35, for example, the flow control valve 9 is opened fully, and the electric pump 8 is activated.

Accordingly, even if the gas R-134*a* is condensed in the gas phase pipe 4 with a low temperature at start of the heating operation, the condensed R-134*a* is exhausted to the gas phase pipe 3 via the flow control valve 9 that is opened fully. Thus, the liquid R-134*a* in the gas phase pipe 4 disappears quickly, thereby the starting time of heating operation can be shortened.

The liquid R-134*a* generated in the gas phase pipe 4 goes down in the pipe. Therefore, even if the flow control valve 9 is opened only in the user side machine 2 that is disposed at the lowest floor for example among the user side machines 2 that are not instructed to perform heating operation by the remote controller 35, the liquid R-134*a* generated in the gas phase pipe 4 are quickly exhausted to the liquid phase pipe 3.

Figure 7:
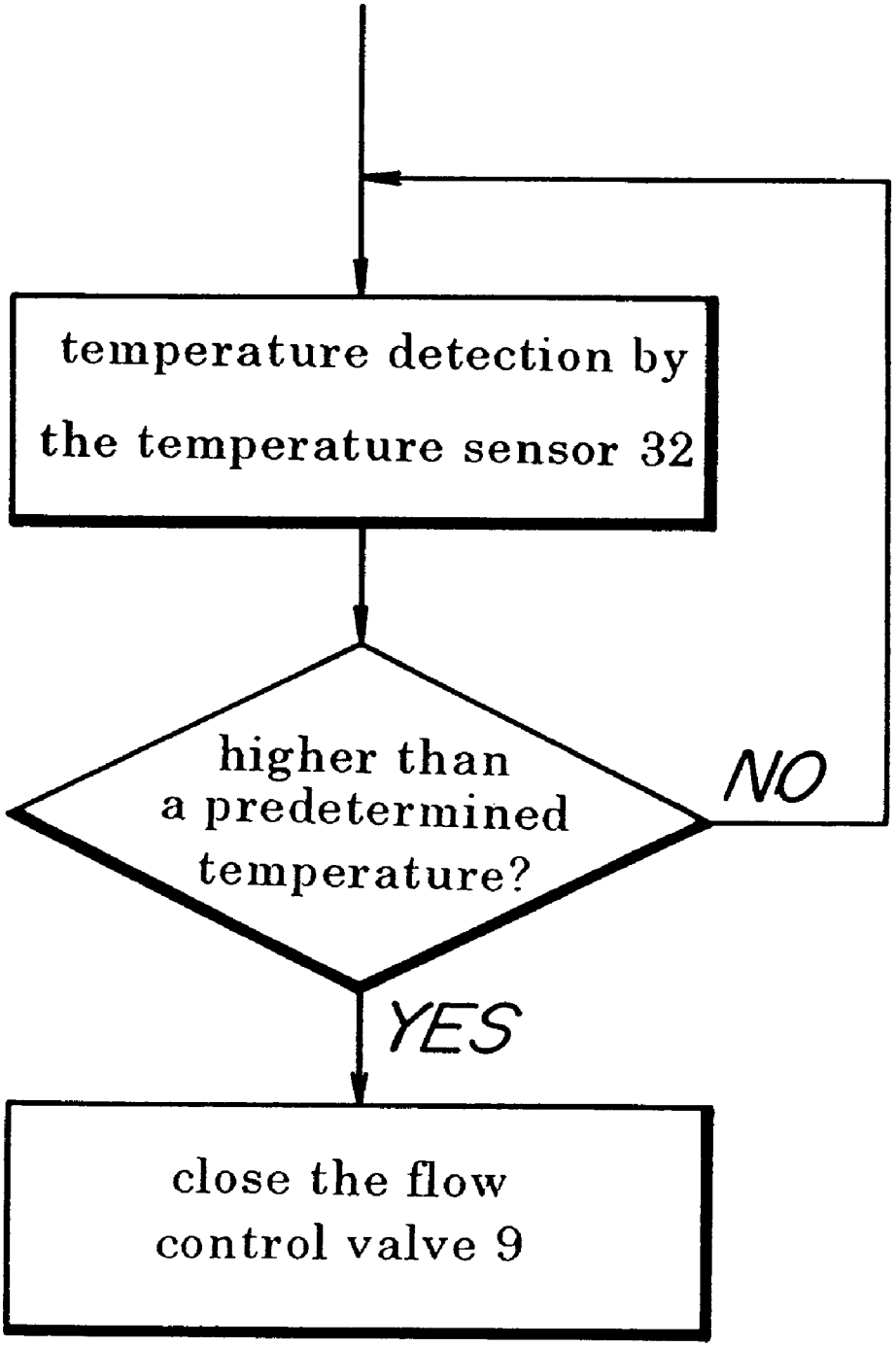
FIG. 7 is an explanatory drawing showing control at start of heating operation of the air conditioning system shown in FIG. 5

The close operation of the flow control valve 9 that is opened fully are performed as shown in FIG. 7, for example. The operation is performed after confirming that the refrigerant evaporated after absorbing heat in the heat source side machine 1 is supplied to the user side machine 2 without being condensed, in accordance with the temperature of the refrigerant 134*a* detected by the temperature sensor 32.

Figure 8:
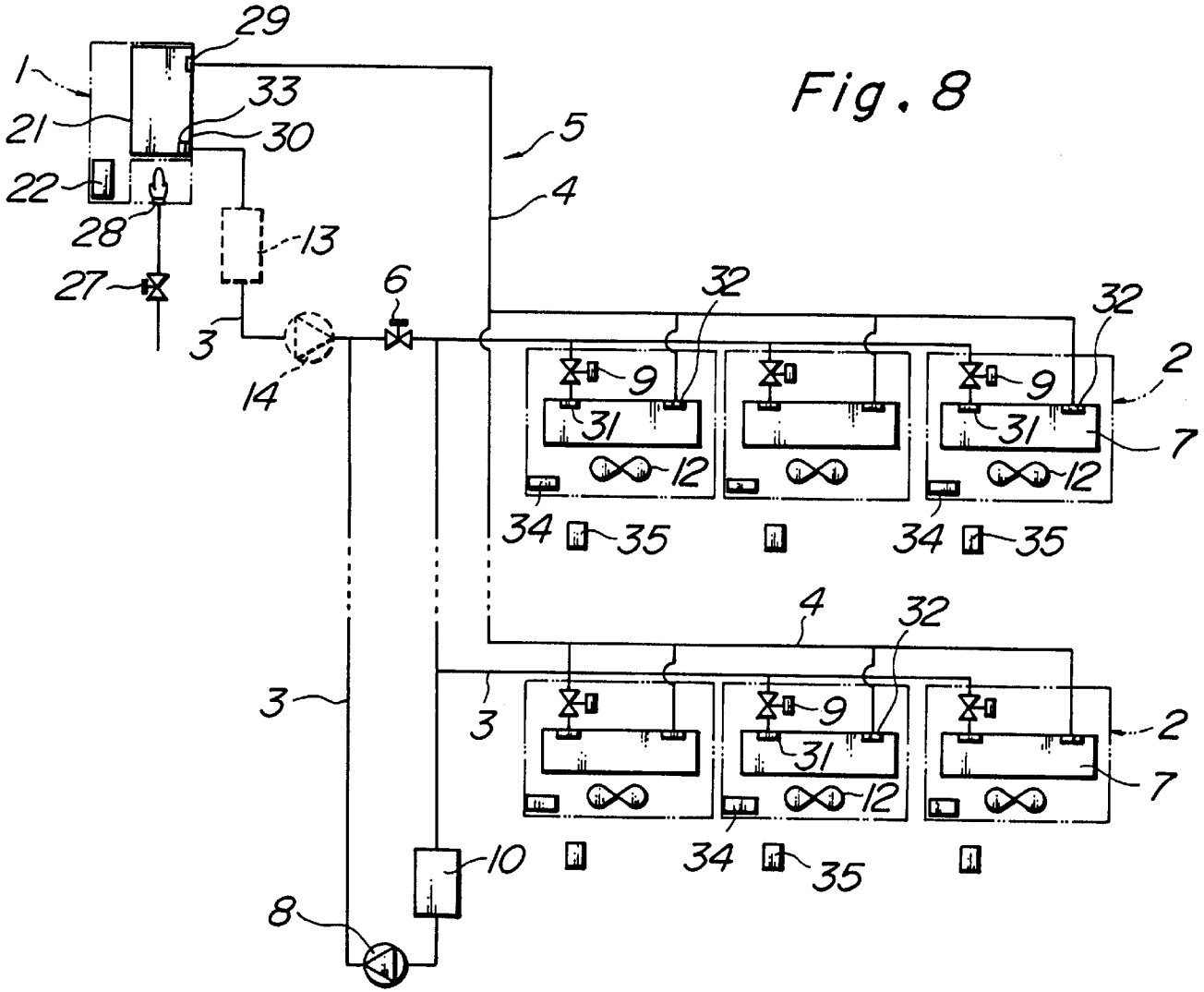
FIG. 8 is an explanatory drawing showing a configuration of an air conditioning system operated by the control method according to the present invention.

The air conditioning system shown in FIG. 8 has a refrigerant circuit that is formed by eliminating the portion of the cooling/heating switch valve 11 from the liquid phase pipe 3 in the air conditioning system shown in FIG. 12. This system comprises the above-mentioned temperature sensors 29–32 as well as a flow rate sensor 33 in the position shown in the figure for detecting a flow rate of the liquid R-134*a* circulating in the closed circuit 5.

The heat source side machine 1 comprising such as an absorption refrigerator and the user side machines 2 have a heat source side controller 22 and a user side controller 34, which can communicate with each other. In addition, each of the user side machines 2 is provided with a remote controller 35, which can communicate with a user side controller 34 for selecting cooling or heating operation, instructing start or stop of the operation, selecting blowing power, setting temperature and other functions.

The heat source side controller 22 controls the operation of the electric pump 8 and the opening/closing of the cooling/heating switch valve 6. In addition, the heat source side controller 22 has a function to control the opening ratio of the fuel adjustment valve 27 so that the temperature of the refrigerant R-134*a* during cooling operation detected by the temperature sensor 30, that is the temperature of the refrigerant R-134*a* cooled and condensed in the heat exchanger 21 to be discharged into the liquid phase pipe 3, becomes a predetermined temperature, e.g., 7 degrees Celsius. Furthermore, the heat source side controller 22 has a function to control the opening ratio of the fuel adjustment valve 27 so that the temperature of the refrigerant R-134*a* during heating operation detected by the temperature sensor 29, that is the temperature of the refrigerant R-134*a* heated and evaporated in the heat exchanger 21 to be discharged into the gas phase pipe 4, becomes a predetermined temperature, e.g., 55 degrees Celsius.

On the other hand, the user side controller 34 has a function to control the opening ratio of the flow control valve 9 so that the temperature of the refrigerant R-134*a* during cooling operation detected by the temperature sensor 32, that is the temperature of the refrigerant R-134*a* heated and evaporated after performing cooling operation in the heat exchanger 7 to be discharged into the gas phase pipe 4, becomes a predetermined temperature, e.g., 12 degrees Celsius. Furthermore, the user side controller 34 has a function to control the opening ratio of the flow control valve 9 so that the temperature of the refrigerant R-134*a* during heating operation detected by the temperature sensor 31, that is the temperature of the refrigerant R-134*a* cooled and condensed after performing heating operation in the heat exchanger 7 to be discharged into the liquid phase pipe 3, becomes a predetermined temperature, e.g., 50 degrees Celsius.

In the heat source side machine 1 during cooling operation, when the opening ratio of the fuel adjustment valve 27 is increased and fuel supplied to the burner 28 is increased for enhancing the firepower, the amount of the vapor refrigerant separating from the absorbing solution (not illustrated) increases. The increased vapor refrigerant is condensed after discharging heat in a condenser (not illustrated). The liquid refrigerant is supplied to periphery of the heat exchanger 21, and evaporates after absorbing heat from the refrigerant R-134*a* flowing in the heat exchanger 21. Thus, the function of cooling the refrigerant R-134*a* flowing in the heat exchanger 21 is enhanced, so that a temperature drop becomes large under the same flow condition. On the contrary, if the opening ratio of the fuel adjustment valve 27 is decreased to lower the firepower of the burner 28, the function of cooling the refrigerant R-134*a* flowing in the heat exchanger 21 is weakened and a temperature drop becomes small.

On the other hand, during heating operation, when the opening ratio of the fuel adjustment valve 27 is increased and fuel supplied to the burner 28 is increased for enhancing the firepower, the amount of the vapor refrigerant separating from the absorbing solution (not illustrated) increases. The increased vapor refrigerant and the absorbing solution after separating vapor refrigerant by being heated are supplied to periphery of the heat exchanger 21, and discharge heat to the refrigerant R-134*a* flowing in the heat exchanger 21. Thus, the function of heating the refrigerant R-134*a* flowing in the heat exchanger 21 is enhanced, so that a temperature rise becomes large under the same flow condition. On the contrary, if the opening ratio of the fuel adjustment valve 27 is decreased to lower the firepower of the burner 28, the function of heating the refrigerant R-134*a* flowing in the heat exchanger 21 is weakened and a temperature rise becomes small.

In the user side machine 2, on the other hand, if the opening ratio of the flow control valve 9 is constant, a difference between temperatures of the refrigerant R-134*a* detected by the temperature sensors 31 and 32 becomes larger when a load for air conditioning is larger, while it becomes smaller when the load for air conditioning is smaller.

Next, the circulation cycle of the refrigerant R-134*a* included in the closed circuit 5 will be explained below. Cooling operation is performed with the cooling/heating switch valve 6 opened and the electric pump 8 stopped in accordance with the control signal outputted by the heat source side controller 22. The heat source side machine 1 performs cooling operation as mentioned above. Thus, the refrigerant R-134*a* is cooled via the pipe wall of the heat exchanger 21, and is condensed to be discharged into the liquid phase pipe 3. The refrigerant R-134*a* is supplied to the user side machine 2 via the cooling/heating switch valve 6 and the flow control valve 9 at a predetermined temperature, e.g., 7 degrees Celsius.

In each of the user side machines 2, since room air with a high temperature is supplied forcibly to the heat exchanger 7 by the blower 12, the liquid R-134*a* supplied from the heat source side machine 1 at 7 degrees Celsius absorbs heat from the room air and evaporates so as to perform cooling operation.

The gas R-134*a* flows in the gas pipe 4 and enters the heat exchanger 21 of the heat source side machine 1 that is in low pressure after the refrigerant R-134*a* is cooled and condensed. Thus, the refrigerant circulates naturally.

In the circulation of the refrigerant R-134*a*, if a cooling load in a certain user side machine 2 increases (or decreases), the temperature of the refrigerant R-134*a* detected by the temperature sensor 32 of the user side machine 2 rises (or drops). In order to compensate the temperature rise (or drop), the user side controller 34 gives a control signal to the corresponding flow control valve 9 to increase (or decrease) the opening ratio of the valve 9. Then, the amount of the refrigerant R-134*a* increases (or decreases) flowing into the heat exchanger 7 of the user side machine 2 in which the cooling load has increased (or decreased). Thus, the temperature rise (or drop) of the refrigerant R-134*a* detected by the temperature sensor 32 is canceled before long.

If the refrigerant R-134*a* whose temperature is changed due to load variation flows into the heat source side machine 1, or if the flow of the refrigerant R-134*a* flowing into the heat source side machine 1 changes, the temperature of the refrigerant R-134*a* detected by the temperature sensor 30 may change. Then, the openinIg ratio of the fuel adjustment valve 27 is controlled by the heat source side controller 22 so that the temperature change is canceled.

However, as mentioned above, at start of the cooling operation when the temperature of the liquid phase pipe 3 is high, for example, the liquid R-134*a* can evaporate and bubble all at once in the liquid phase pipe 3. This can be an obstacle to the circulation and supply of the liquid R-134*a* to each of the user side machines 2. Therefore, not only starting the heat source side machine 1 with the cooling/heating switch valve 6 opened, but also stopping the blower 12 in all or some of the user side machine 2 that are not instructed to perform cooling operation by the remote controller 35, the flow control valve 9 of the user side machine is forcibly opened, e.g., fully, and the electric pump 8 is activated to start cooling operation.

By this starting operation, the liquid R-134*a* remaining in the receiver tank 10 and in the periphery of the electric pump 8, and the liquid R-134*a* condensed after cooled in the heat exchanger 21 of the heat source side machine 1 are mixed and circulate to be supplied to the heat exchanger 7 of the user side machine 2. Therefore, the liquid R-134*a* in the liquid phase pipe 3 is prevented from boiling all at once. Especially, even if all of the user side machines are not instructed to perform cooling operation when the heat source side machine 1 starts, and thus all of the user side machines 2 are to wait with the flow control valve 9 closed, the flow control valves 9 of all or some of the user side machines 2 are opened when the heat source side machine 1 starts in accordance of the present control. Therefore, even if the liquid R-134*a* generates bubbles in the liquid phase pipe 3 that is in a low pressure at the starting time, the bubbles flow in the user side machines 2 quickly via the flow control valve 9 that is opened, and are exhausted to the gas phase pipe 4.

Figure 9:
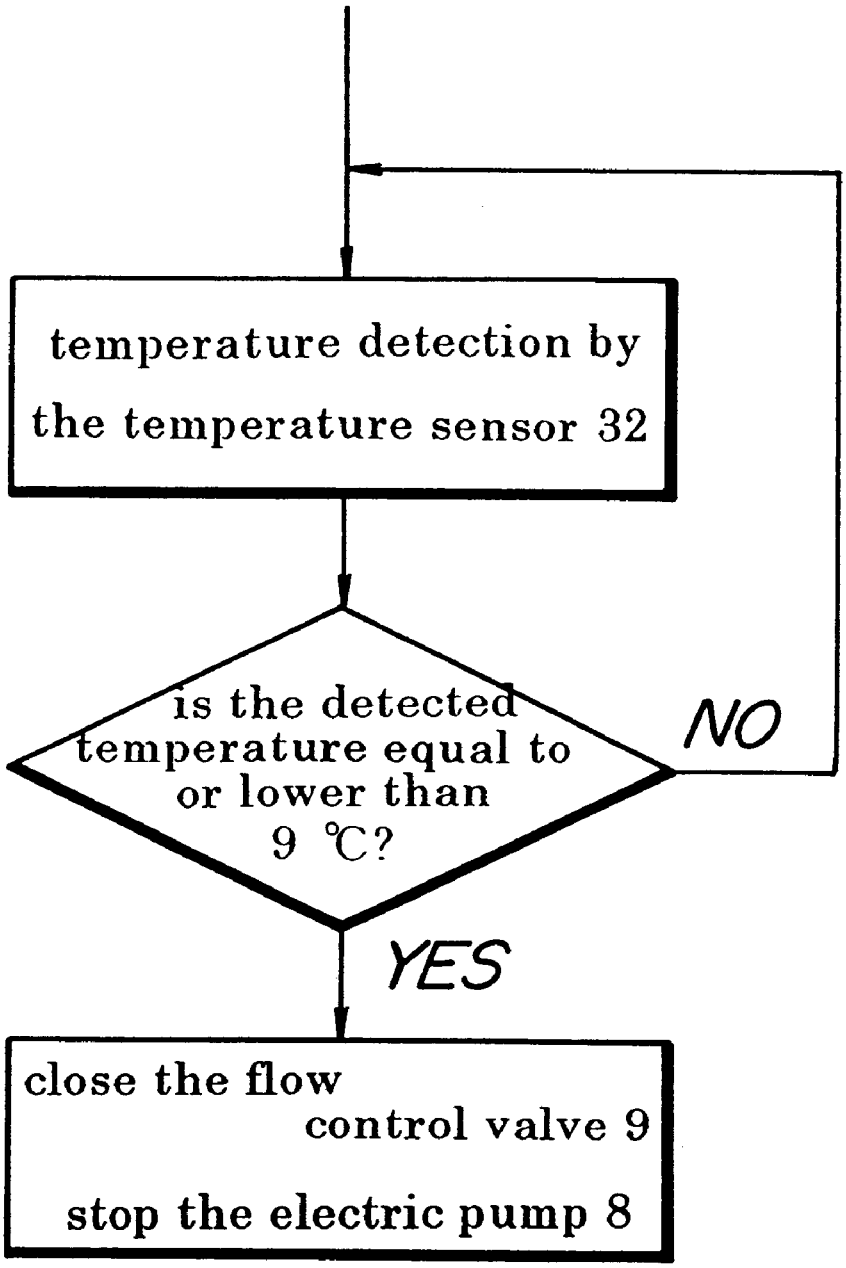
FIG. 9 is an explanatory drawing showing control of the air conditioning system shown in FIG. 8.

Therefore, the circulation and supply of the liquid R-134*a* to the user side machines 2 are not disturbed. In the user side machine 2 that perform cooling operation, the liquid R-134*a* supplied to the heat exchanger 7 exchanges heat with room air having a high temperature supplied by the blower 12, and cool the air. The refrigerant R-134*a* is heated and evaporates to be discharged into the gas phase pipe 4. The temperature of the refrigerant R-134*a* detected by the temperature sensor 32 falls gradually. Therefore, as shown in FIG. 9 for example, after the temperature becomes lower than a predetermined temperature, e.g., 9 degrees Celsius, the electric pump 8 is stopped, the flow control valve 9 is closed in the user side machines 2 that are not instructed to perform cooling operation to finish controlling start of the cooling operation. Thus, the starting time of the cooling operation can be shortened.

The bubbles of the refrigerant R-134*a* generated in the liquid phase pipe 3 go up in the pipe. Therefore, even if the flow control valve 9 is opened only in the user side machine 2 that is disposed at the highest floor for example among the user side machines 2 that are not instructed to perform cooling operation by the remote controller 35, the bubbles of the refrigerant R-134*a* generated in the liquid phase pipe 3 are quickly exhausted to the gas phase pipe 4. Therefore, it is possible to control only the flow control valve 9 of the user side machine 9 disposed at the highest floor.

The stopping operation of the electric pump 8 and the closing of the flow control valve 9 of the user side machine 2 that is not instructed to perform cooling operation can be performed after a slope in the temperature drop of the refrigerant R-134*a* detected by the temperature sensor 32 becomes lower than a predetermined value. Alternatively, they can be controlled in accordance with an output of a temperature sensor for detecting a temperature of the room air cooled by exchanging heat in the heat exchanger 7. Furthermore, they can be controlled in accordance with a pressure of the R-134*a* discharging into the gas phase pipe.

In addition, when the liquid R-134*a* generates bubbles in the liquid phase pipe 3, the volume of the liquid R-134*a* increases on the surface, and the liquid level rises in the heat exchanger 21. On the contrary, when the bubbles disappear, the liquid level falls in the heat exchanger 21. Therefore, it is possible to stop the electric pump 8 and to close the flow control valve 9 that was opened at start, after confirming that the bubbles have disappeared from the refrigerant R-134*a* in the liquid phase pipe 3, i.e., detecting the falling of the liquid level of the refrigerant R-134*a* by a proper liquid level sensor, e.g., the liquid sensor 26 shown in FIG. 5.

Next, the circulation cycle of the refrigerant R-134*a* in the heating operation with the cooling/heating switch valve 6 opened and the electric pump 8 activated is explained below. The heat source side machine 1 performs heating operation as mentioned above. The refrigerant R-134*a* is heated via the pipe wall of the heat exchanger 21 and is evaporated. Then the evaporated refrigerant R-134*a* is discharged into the gas phase pipe 4 and is supplied to the heat exchanger 7 of each user side machine 2 at a predetermined temperature, e.g., 55 degrees Celsius.

In each of the user side machine 2, since room air with a low temperature is supplied forcibly to the heat exchanger 7 by the blower 12, the liquid R-134*a* supplied from the heat source side machine 1 at 55 degrees Celsius discharges heat to the room air and is condensed so as to perform heating operation.

The condensed liquid R-134*a* remains in the receiver tank 10 and is drove to the heat exchanger 21 of the heat source side machine 1 via the liquid phase pipe 3 by the electric pump 8.

In the circulation of the refrigerant R-134*a*, if a heating load in a certain user side machine 2 increases (or decreases), the temperature of the refrigerant R-134*a* detected by the temperature sensor 31 of the user side machine 2 drops (or rises). In order to compensate the temperature drop (or rise), the user side controller 34 gives a control signal to the corresponding flow control valve 9 to increase (or decrease) the opening ratio of the valve 9. Then, the amount of the refrigerant R-134*a* increases (or decreases) flowing into the heat exchanger 7 of the user side machine 2 in which the heating load has increased (or decreased). Thus, the temperature drop (or rise) of the refrigerant R-134*a* detected by the temperature sensor 31 is canceled before long.

If the refrigerant R-134*a* whose temperature is changed due to load variation flows into the heat source side machine 1, or if the flow of the refrigerant R-134*a* flowing into the heat source side machine 1 changes, the temperature of the refrigerant R-134*a* detected by the temperature sensor 30 may change. Then, the opening ratio of the fuel adjustment valve 27 is controlled by the heat source side controller 22 so that the temperature change is canceled.

The air conditioning system can be one that includes a receiver tank 13 and a small electric pump 14 as an auxiliary pump for cooling as illustrated in the broken line in FIG. 8. In the air conditioning system having this configuration, adding to the specific gravity difference between liquid and gas phases, a drive force of the electric pump 14 can be used in cooling operation. Therefore, some of the user side machines 2 can be placed at a position equal to or higher than the heat source side machine 1.

The cooling operation of the air conditioning system having the electric pump 14 is started by starting the heat source side machine 1 and the electric pump 8 and 14 with the flow control valve 9 opened in all or some of the user side machines 2 that are not instructed to perform cooling operation.

By this starting operation too, the liquid R-134*a* remaining in the receiver tank 10 and in the periphery of the electric pump 8, and the liquid R-134*a* condensed after cooled in the heat exchanger 21 of the heat source side machine 1 are mixed and circulate. Therefore, the liquid R-134*a* in the liquid phase pipe 3 is prevented from boiling all at once. Even if the liquid R-134*a* generates bubbles in the liquid phase pipe 3 that is in a low pressure at the starting time, the bubbles flow in the user side machines 2 quickly via the flow control valve 9 that is opened, and are exhausted to the gas phase pipe 4.

The temperature of the refrigerant R-134*a* detected by the temperature sensor 32 falls gradually. Therefore, after the temperature becomes lower than a predetermined temperature, e.g., 9 degrees Celsius, the electric pump 8 is stopped, the flow control valve 9 is closed in the user side machines that are not instructed to perform cooling operation to finish controlling start of the cooling operation.

In the air conditioning system without the receiver tank 10, the electric pump 8 and the cooling/heating switch valve 6, and having a receiver tank 13 and the electric pump 14 as an auxiliary pump for cooling to perform only cooling operation, the heat source side machine 1 and the electric pump 14 are started with the flow control valve 9 opened in all or some of the user side machines that is not instructed to perform cooling operation.

By this starting operation, even if the liquid R-134*a* generates bubbles in the liquid phase pipe 3 that is in a low pressure at the starting time, the bubbles flow in the user side machines 2 quickly via the flow control valve 9 that is opened, and are exhausted to the gas phase pipe 4.

The temperature of the refrigerant R-134*a* detected by the temperature sensor 32 falls gradually. Therefore, after the temperature becomes lower than a predetermined temperature, e.g., 9 degrees Celsius, the flow control valve 9 is closed in the user side machines that are not instructed to perform cooling operation to finish controlling start of the cooling operation.

Figure 10:
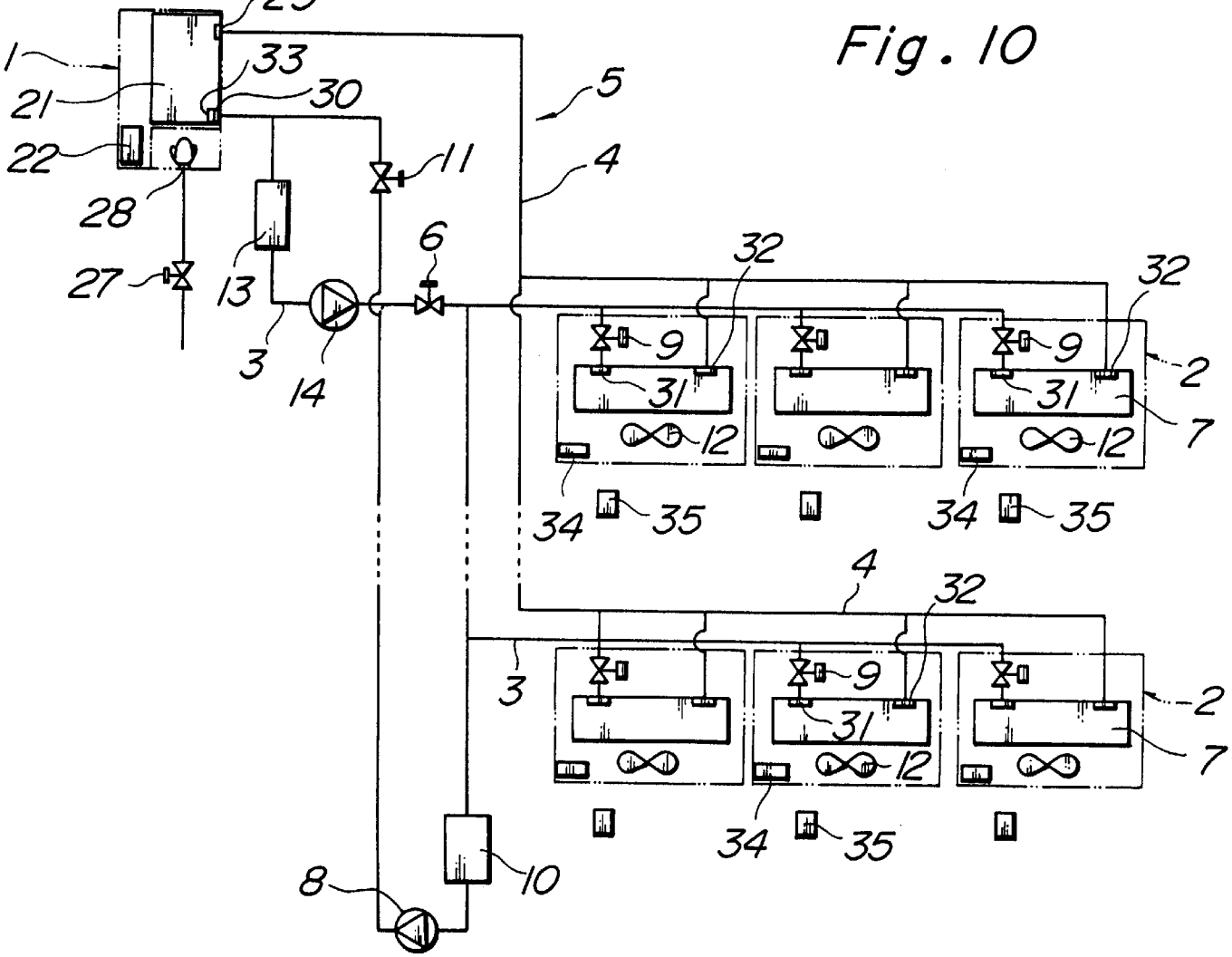
FIG. 10 is an explanatory drawing showing a configuration of an air conditioning system operated by the control method according to the present invention.

The air conditioning system shown in FIG. 10 includes the receiver tank 13 and the electric pump 14 as shown in the broken line in FIG. 8, and the outlet side of the electric pump 8 is connected to the inlet side of the receiver tank 13 via the cooling/heating switch valve 11. Cooling operation is performed by opening the cooling/heating switch valve 6, closing the cooling/heating switch valve 11, activating the electric pump 14 and inactivation the electric pump 8. Heating operation is performed by closing the cooling/heating switch valve 6, opening the cooling/heating switch valve 11, inactivating the electric pump 14 and activation the electric pump 8. Therefore, both in the cooling operation and the heating operation, the refrigerant R-134*a* in the closed circuit 5 circulates in the same way as the air conditioning system shown in FIG. 8.

This configuration of the air conditioning system has an advantage in that a carrier resistance is small compared with the configuration of the air conditioning system shown in FIG. 8 since the liquid R-134*a* driven by the electric pump 8 to the heat source side machine 1 during heating operation does not pass the electric pump 14.

In this configuration of the air conditioning system, when starting cooling operation, both of the cooling/heating switch valves 6 and 11 are opened, the flow control valve 9 of all or some of the user side machines 2 that are not instructed to perform cooling operation are opened, and both of the electric pumps 8 and 14 are activated. The liquid R-134*a* remaining in the receiver tank 10 and in the periphery of the electric pump 8, and the liquid R-134*a* condensed after cooled in the heat exchanger 21 of the heat source side machine 1 are mixed and circulate. Therefore, the liquid R-134*a* in the liquid phase pipe 3 is prevented from boiling all at once. Even if the liquid R-134*a* generates bubbles in the liquid phase pipe 3 that is in a low pressure at the starting time, the bubbles flow in the user side machines 2 quickly via the flow control valve 9 that is opened, and are exhausted to the gas phase pipe 4.

Figure 11:
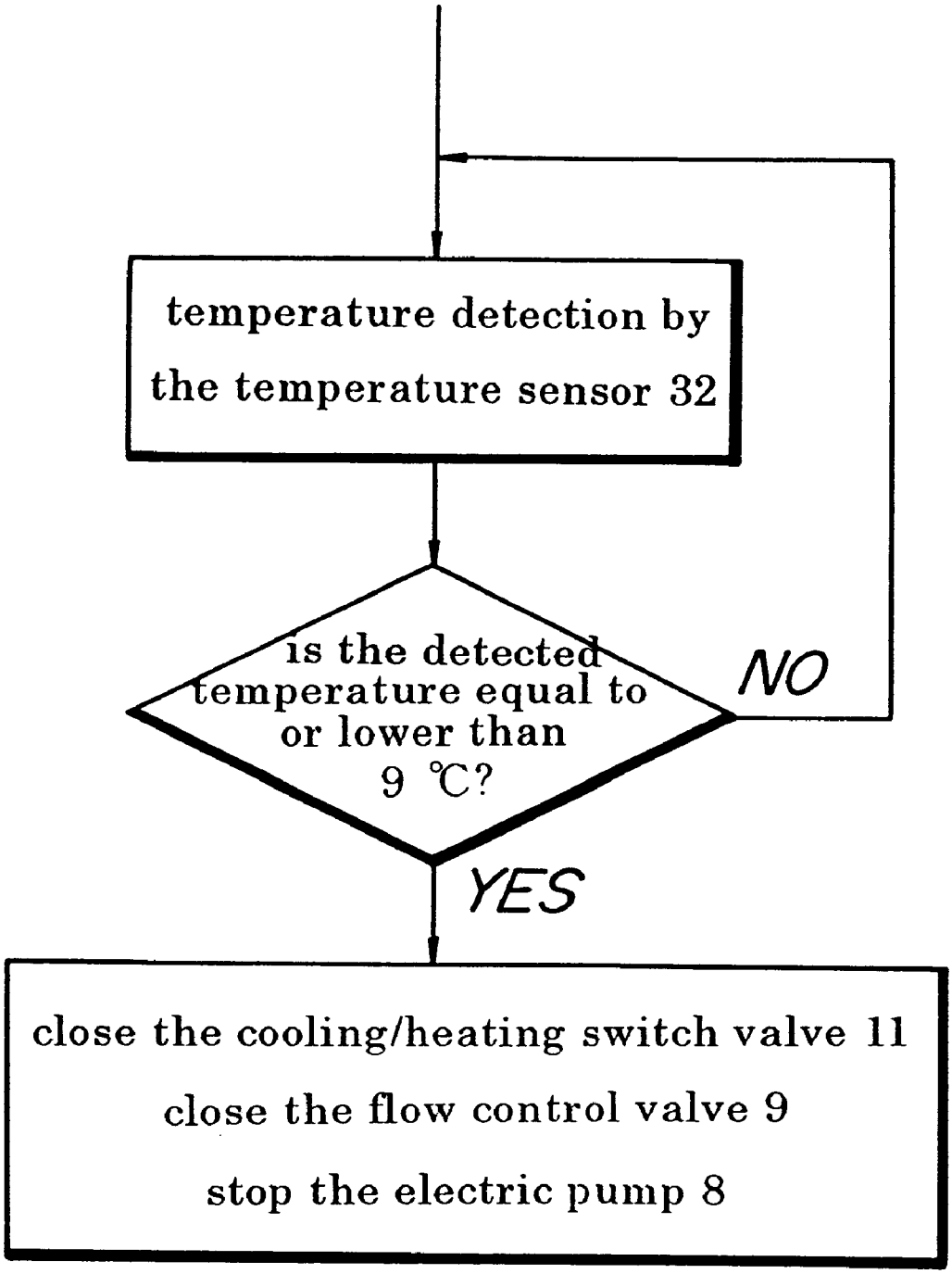
FIG. 11 is an explanatory drawing showing control of the air conditioning system shown in FIG. 10.

The temperature of the refrigerant R-134*a* detected by the temperature sensor 32 falls gradually. Therefore, as shown in FIG. 11 for example, after the temperature becomes lower than a predetermined temperature, e.g., 9 degrees Celsius, the flow control valve 9 and the cooling/heating switch valve 11 is closed in the user side machines 2 that are not instructed to perform cooling operation, and the electric pump 8 is stopped to finish controlling start of the cooling operation.

A timing to close the flow control valve 9 and the cooling/heating switch valve 11 of the user side machines 2 that are not instructed to perform cooling operation, and a timing to stop the electric pump 8 can be set in various ways similarly to the air conditioning system shown in FIG. 8.

The operation method explained with referring to FIG. 10 is also valid for a configuration of the air conditioning system shown in the broken line in FIG. 10, in which the discharging side of the electric pump 8 is branched into two paths, one of the paths is connected to the inlet side of the receiver tank 13 via the cooling/heating switch valve 11, and the other is connected to the node between the electric pump 14 and the cooling/heating switch valve 6.

In this configuration of the air conditioning system in which the discharging side of the electric pump 8 is connected to the node between the electric pump 14 and the cooling/heating switch valve 6 too, the configuration of the system becomes the same as that of the system shown in FIG. 8 if the cooling/heating switch valve 11 is closed. Therefore, in the same way as the air conditioning system shown in FIG. 8, the cooling/heating switch valve 11 is closed, the cooling/heating switch valve 6 are opened, and the flow control valve 9 is opened in all or some of the user side machines 2 that are not instructed to perform cooling operation so as to start only the heat source side machine 1 and the electric pump 8. Alternatively, the electric pump 14 is activated too, and later, the flow control valve 9 is closed in the user side machines 2 that are not instructed to perform cooling operation, and the electric pump 8 is stopped. Thus, as explained above, the generation of bubbles in the liquid phase pipe 3 is suppressed, and the bubbles, even if generated, are exhausted quickly, so that the starting time of the cooling operation can be shortened.

When connecting the discharging side of the electric pump 8 to the node between the electric pump 14 and the cooling/heating switch valve 6 too, it is preferable to lead the connecting pipe gently as shown in the broken line so that the refrigerant R-134*a* discharged from the electric pump 8 can flow into the cooling/heating switch valve 6 smoothly.

By arranging the liquid phase pipe as mentioned above, adding the smooth flow of the refrigerant R-134*a* discharged from the electric pump 8 into the cooling/heating switch valve 6, the refrigerant R-134*a* condensed in the heat exchanger 21 of the heat source side machine 1 and discharged into the liquid phase pipe 3 is affected by the suction force due to the refrigerant R-134*a* driven by the electric pump to the cooling/heating switch valve 6. Therefore, the refrigerant R-134*a* can be driven to the cooling/heating switch valve 6 side by the electric pump 14 operating in a small power. In addition, the refrigerant R-134*a* can be driven to the cooling/heating switch valve 6 side without starting the electric pump 14.

Concerning the pipe arrangement in the discharging side of the electric pump 8 shown in FIG. 8, it is preferable to connect the pipe toward the cooling/heating switch valve 6 as shown in the broken line in FIG. 10 in the start of the cooling operation, and to connect it toward the heat source side machine 1 during the heating operation, utilizing proper valves or other means.

The present invention is not limited to the above-explained embodiments, but can be embodied in various ways without departing from the scope of the claims.

For example, the phase-changeable fluid included in the closed circuit 5 is not limited to R-134*a*, but can be R-407*c*, R-404A, R-410*c* or other fluid that can change its phase easily by controlling the temperature and the pressure.

As explained above, according to the present invention, if bubbles are generated in the liquid phase pipe during cooling operation, the bubbles are exhausted quickly to the gas phase pipe. Therefore, the generated bubbles do not influence the circulation of the liquid refrigerant to each of the user side machines. Thus, the starting time of the cooling operation can be shortened. In addition, if the bubbles are generated in the refrigerant within the liquid phase pipe in which the pressure drops suddenly during operation, the bubbles are exhausted quickly from the liquid phase pipe, so that a normal cooling operation is maintained.

Furthermore, during heating operation, if condensed liquid is generated in the gas phase pipe, the liquid can be exhausted quickly to the liquid phase pipe. Therefore, the generated condensed liquid does not influence the circulation of the gas refrigerant to each of the user side machines. Thus, the starting time of the heating operation can be shortened. In addition, if the refrigerant is condensed within the liquid phase pipe, the condensed liquid are exhausted quickly from the gas phase pipe, so that a normal heating operation is maintained.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. An air conditioning system, comprising a heat source side machine;

a plurality of user side machines more than half of which are disposed below the heat source side machine;

pipes for communicating the heat source side machine with the user side machines, the pipes including a liquid phase pipe provided with a pump and a gas phase pipe so as to form a closed system;

a phase-changeable fluid included in the closed circuit circulating between the heat source side machine and the user side machine by utilizing its own specific gravity difference between the liquid and gas phases and a discharging force of the pump, so that each of the use side machines can perform cooling operation;

a second liquid phase pipe extending from the lower portion of the liquid phase pipe connecting with the lowest user side machine to the heat source side machine; and the second liquid phase pipe provided with a second pump for driving the phase-changeable fluid to the heat source machine, and control means for operating the second pump when bubbles are detected in the liquid phase pipe during cooling operation.

* * * * *

UNITED STATES PATENT AND TRADEMARK OFFICE

CERTIFICATE OF CORRECTION

PATENT NO. : 6,220,341 B1
DATED : April 24, 2001
INVENTOR(S) : Masashi Izumi et al.

It is certified that error appears in the above-identified patent and that said Letters Patent is hereby corrected as shown below:

Column 10,
Line 29, "R-134aflowing" should read -- R-134a flowing --;

Column 12,
Line 64, "R-134acirculates" should read -- R-134a circulates --;

Column 13,
Line 13, "R-134acondensed" should read -- R-134a condensed --;
Line 48, "R-134acooled" should read -- R-134a cooled --;
Line 61, "R-134aduring" should read -- R-134a during --; and Column 20,
Line 1, "openinIg" should read -- opening --.

Signed and Sealed this

Twenty-second Day of October, 2002

*Attest:*

*Attesting Officer*

JAMES E. ROGAN
*Director of the United States Patent and Trademark Office*